US006896256B2

(12) United States Patent
Hozumi

(10) Patent No.: US 6,896,256 B2
(45) Date of Patent: May 24, 2005

(54) SHEET TRANSPORT APPARATUS AND IMAGE FORMATION APPARATUS THEREWITH

(75) Inventor: Shinji Hozumi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 135 days.

(21) Appl. No.: 10/298,601

(22) Filed: Nov. 19, 2002

(65) Prior Publication Data

US 2004/0212144 A1 Oct. 28, 2004

(30) Foreign Application Priority Data

Nov. 21, 2001 (JP) ..... P2001-356671

(51) Int. Cl.[7] ..... B65H 7/02

(52) U.S. Cl. ..... 271/228; 271/227; 271/248; 271/250; 271/252

(58) Field of Search ..... 271/227, 248, 271/228, 250, 252

(56) References Cited

U.S. PATENT DOCUMENTS 4,685,664 A * 8/1987 Petersdorf ..... 271/227
5,697,609 A * 12/1997 Williams et al. ..... 271/228
6,634,521 B1 * 10/2003 Hwang ..... 221/228

* cited by examiner

*Primary Examiner*—Donald P. Walsh
*Assistant Examiner*—Kaitlin Joerger
(74) *Attorney, Agent, or Firm*—Morgan Lewis & Bockius LLP

(57) ABSTRACT

A sheet transport apparatus comprises a predetermined number of transport members 2 disposed in a sheet transport passage 1. At least a part of the transport members 2 is a multi-direction transport member 4 for variably setting the transport direction of a sheet 3 to a plurality of directions. To perform direction switch control of the multi-direction transport member 4, the sheet transport apparatus comprises a transport direction switch unit 8 that can switch the transport direction of the sheet 3 by the multi-direction transport member 4 at a predetermined timing. Alternatively, the sheet transport apparatus comprises a guide member 9 for regulating a side position of the sheet 3.

17 Claims, 21 Drawing Sheets

SHEET TRANSPORT APPARATUS AND IMAGE FORMATION APPARATUS THEREWITH

BACKGROUND OF THE INVENTION

This invention relates to a sheet transport apparatus for transporting a sheet along a predetermined path and in particular to improvements in a sheet transport apparatus used for changing the sheet transport direction and an image formation apparatus using the sheet transport apparatus.

Generally, an image formation apparatus using electrophotography, etc., adopts, for example, a technique of forming an electrostatic latent image responsive to an image signal on a latent image support such as a photoconductor drum and transferring an image provided by developing the electrostatic latent image (toner image) directly or through an intermediate transfer body to a sheet of paper, etc.

In such an image formation apparatus, to precisely transfer an image onto a sheet, usually the sheet is registered to a predetermined reference position, and as a registering technique, side registration of registering, for example, a side of a sheet to a predetermined side reference position and then sending the sheet to a transfer position is available.

In this kind of side registration, usually a skew correction of correcting the transport attitude of a sheet is performed.

The skew correction is as follows: For example, a skew roll as an aligner is disposed in a sheet transport passage, a side guide is disposed on one side of the sheet transport passage, and the sheet transported by the skew roll is pressed against the side guide, whereby the side of the sheet is registered to a reference position provided by the side guide and the transport attitude of the sheet is corrected.

As lead registration of registering the lead of a sheet, a roll nip technique of once stopping a sheet in a nip area of a registration roll and registering the lead of the sheet at the restart timing of the registration roll, a gate technique of once stopping a sheet at a gate and registering the lead of the sheet at the opening timing of the gate, a roll rotation control technique of controlling the number of rotations, etc., of a registration roll for making the transport speed of a sheet variable and adjusting the arrival timing of the sheet at a transfer position, or the like is widely adopted.

In such a skew correction technique in the related art (skew roll+side guide), the following technical problems are found:

First, the types of sheets that can be used are limited drastically.

That is, in this kind of skew correction, if the sheet type (for example, paper thickness, rigidity, material property of pulp, presence or absence of coat layer, thickness of coat layer, material property of coat layer, etc.) differs, the transport force, etc., of the sheet changes and variations in skew or the arrival time of the sheet at the target position change for the worse.

For example, if the thickness of a sheet changes, the sheet rigidity and the transport resistance between the sheet and a chute change. If the coat material of a surface coat layer changes, the coat layer adheres to the skew roll the frictional resistance between the skew roll and the sheet changes, and variations in the transport force become large. In addition, if the environment changes, further the variations in the transport force change for the worse.

Thus, in the skew correction technique in the related art, the types of sheets that can be used are limited to a considerably narrow range (for example, basis weight in the range of 65 to 95 gsm, non-coated paper).

Second, if the skew correction technique using "skew roll and side guide" is adopted, slip transport is executed and thus the variations in the arrival time of the sheet at the target position become large.

Generally, most of sheet transport is grip transport wherein a drive transport roll and a driven transport roll rotate in the same direction and a sheet is always transported with the sheet gripped.

In the grip transport, a slip scarcely occurs between the sheet and the transport roll and a transport speed error is caused by roll diameter variations (tolerance) and drive system variations; the value is small and particularly the tolerance is lessened, whereby the error can be easily minimized.

Since a plurality of transport rolls are placed axially and the sheet is supported on several transport rolls in the transport direction, the transport error becomes an average value thereof and thus the diameter variations are largely decreased and the variations in the arrival time of the sheet are also lessened (for example, ±30 ms or less).

However, if the skew correction technique using "skew roll and side guide" is adopted, a drive transport roll and a driven transport roll rotate in different directions and a sheet is always transported in a slip state.

In this case, the sheet is transported by an unstable transport force of slip between the sheet and the transport roll and thus it is impossible to precisely control registration of the lead of the sheet and consequently the variations in the arrival time of the sheet at the target position become large.

More specifically, to perform registration of the lead of the sheet with high accuracy, after skew correction of the sheet is made, often the roll rotation control technique of controlling the number of rotations, etc., of a registration roll for making the transport speed of a sheet variable and adjusting the arrival timing of the sheet at a transfer position is adopted.

Under such circumstances, the adjustment range of the arrival timing of the sheet at the transfer position is determined by the process speed and the pitch between sheets; a system with a larger adjustment range value is resistant to disturbance.

Here, to enlarge the adjustment range, (1) the process speed must be made lower or (2) the pitch between sheets must be enlarged; normally, to raise the productivity of an image formation apparatus as much as possible, the process speed must be increased as much as possible and the pitch between sheets must be lessened as much as possible. It is not easy to enlarge the adjustment range sufficiently.

On the other hand, to execute skew correction, if slip transport technique is adopted as a skew roll, the variations in the arrival time of the sheet become large (for example, 200 ms or more) and may be placed out of the adjustment range under the rotation speed control of downstream registration roll and may be placed out of control. Particularly, if an attempt is made to transport various sheets or the environment changes, the variations become noticeably large.

Third, at the skew correction time with the skew roll, a stress is placed on a sheet.

That is, in the skew correction in the related art, the inclination of the skew roll is fixed uniquely and thus a force attempting to advance in a slanting direction occurs on the lead of a sheet at the same time as the sheet enters the nip area of the skew roll, but a force attempting to advance straightly continues to occur on the tail of the sheet and a stress is given to the sheet accordingly.

Since the inclination of the skew roll is fixed uniquely, the force of the component in a direction at right angles to the transport direction (skew correction force) continues to occur on the sheet after undergoing the skew correction.

Thus, the frictional resistance force provided by multiplying a friction coefficient by the skew correction force occurs between the sheet edge and side guide and becomes a resistance force to sheet transport, giving a stress to the sheet.

Particularly, if high nip pressure is required for skew correction as with a cardboard, the frictional resistance force becomes large.

Fourthly, if the variations in the arrival time of a sheet at a transfer position are suppressed, skew worsens because of secondary trouble.

That is, to suppress the variations in the arrival time of the sheet, if the nip pressure of the skew roll is strengthened for increasing the transport force, it is made possible to stabilize the transport time of the sheet.

However, if the strength of the nip pressure of the skew roll is not adequate, the transport force may be too increased and the frictional resistance force between the sheet and side guide may become large, placing the sheet in a stop state.

However, the force in the transport direction and the force in the side guide direction (skew correction force) occur on the skew roll and thus if the nip pressure of the skew roll is strengthened, the skew correction force of pressing the sheet against the side guide is also increased inevitably. If the skew correction force is increased, it is feared that the sheet may buckle and skew may worsen, namely, secondary trouble may occur.

Thus, strengthening the nip pressure also involves an adequate range and the skew correction force cannot be ignored and thus it is not easy to strengthen the nip pressure for stabilizing the arrival time of the sheet.

SUMMARY OF THE INVENTION

It is therefore an object of the invention to provide a sheet transport apparatus for making it possible to switch the transport direction of a sheet while stably transporting the sheet without giving a stress to the sheet, and an image formation apparatus using the sheet transport apparatus.

According to aspect 1, the present invention provides a sheet transport apparatus including a predetermined number of transport members disposed in a sheet transport passage, and a predetermined number of multi-direction transport member among the transport member for variably setting a transport direction of a sheet to a plurality of directions disposed in a downstream in the transport direction of the sheet from a point of the transport members.

That is, according to the invention, there is provided a sheet transport apparatus comprising a predetermined number of transport members 2 disposed in a sheet transport passage 1, characterized in that at least apart of the transport members 2 is a multi-direction transport member 4 for variably setting the transport direction of a sheet 3 to a plurality of directions, as shown in FIGS. 1A and 1B.

In such technical means, the transport member 2 usually consists of a pair of transport members and may have a configuration capable of transporting a sheet. The transport member 2 includes not only a roll, but also a belt.

The multi-direction transport member 4 may comprise a function section for variably setting the transport direction of the sheet 3 to a plurality of directions, and includes various forms.

Here, a representative form of the multi-direction transport member 4 can comprise a drive transport member 5 driven for rotation and a driven transport member 6 for coming in contact with the drive transport member 5 and rolling for performing nip transport of the sheet 3, and changes the transport direction of the sheet 3 by the drive transport member 5 and the driven transport member 6.

In this case, the change form of "the transport direction of the sheet 3" includes not only change in the same plane direction, but also change in the height direction.

Further, as a representative form for using the multi-direction transport member 4 as a skew transport member, at least either of the drive transport member 5 and the driven transport member 6 may be supported swingably along a nip face direction of the sheet 3 and a nip area between both the transport members 5 and 6 may be set downstream in the transport direction of the sheet 3 from a swing supporting point 7.

Thus, if the multi-direction transport member 4 is formed as trail form, the transport direction of the sheet 3 by the multi-direction transport member 4 can be changed easily.

In this kind of form, as a representative form wherein one transport member is of position fix type, at least either of the drive transport member 5 and the driven transport member 6 comprises a plurality of transport bodies disposed along a plurality of transport directions.

Particularly, from the viewpoint of simplifying the configuration, preferably the drive transport member 5 comprises a plurality of transport bodies disposed along a plurality of transport directions.

As a representative form of the swing support structure of the multi-direction transport member 4, at least either of the drive transport member 5 and the driven transport member 6 of the multi-direction transport member 4 may comprise a swing arm supported swingably along the nip face direction of the sheet 3 and a transport body placed in contact with the opposed mated transport member placed downstream in the transport direction of the sheet from a swing supporting point 7 of the swing arm.

Further, in the form wherein a plurality of multi-direction transport members 4 are disposed along the transport direction of the sheet 3, the plurality of multi-direction transport members 4 may be ganged together through an interlock mechanism.

The interlock mechanism mentioned here refers to a link mechanism for joining swing-type transport members, for example, (a link bar, etc.).

According to the form, direction setting of the plurality of multi-direction transport members 4 can be accomplished easily.

To perform direction switch control of the multi-direction transport member 4, the sheet transport apparatus may comprise a transport direction switch unit 8 that can switch the transport direction of the sheet 3 by the multi-direction transport member 4 at a predetermined timing.

The transport direction switch unit 8 is a concept containing a controller and a switch mechanism thereof, for example.

Further, the transport direction switch unit 8 directly or indirectly controls switching the transport direction of the sheet 3 by the multi-direction transport member 4.

The word "indirectly" mentioned here is used to mean switching the transport direction by the multi-direction transport member 4 in association with changing the guide direction by a guide member, for example.

As a representative form of the transport direction switch unit 8, in the form wherein the multi-direction transport member 4 comprises a drive transport member 5 driven for rotation and a driven transport member 6 for coming in contact with the drive transport member and rolling for performing nip transport of the sheet 3 with the drive transport member 5, when switching the transport direction of the sheet, the transport direction switch unit 8 can roughly match the rotation direction of the drive transport member 5 and the driven transport member 6 in the nip area therebetween with the transport direction of the sheet 3 so as to make it possible to execute grip transport of the sheet 3 relative to the transport direction of the sheet 3.

According to the form, to transport the sheet 3, "slip transport" can be switched to "grip transport" for lessening a transport error of the sheet 3.

The "slip transport" mentioned here refers to the state in which the drive transport member 5 and the driven transport member 6 rotate in different directions in the nip area.

Further, as a representative form of the transport direction switch unit 8, in the form wherein the transport direction of the sheet 3 by the multi-direction transport member 4 is changed to a different direction from the transport direction of the sheet 3 by upstream transport member, the transport direction switch unit 8 can set the transport direction of the sheet 3 by the multi-direction transport member 4 to the same direction as the transport direction of the sheet 3 by the upstream transport member 2*a* (2) provided that the sheet 3 rushes into the multi-direction transport member 4, and can set the transport direction of the sheet 3 by the multi-direction transport member 4 to a different direction from the transport direction of the sheet 3 by the upstream transport member provided that the trail of the sheet 3 exits the upstream transport member 2*a* (2).

According to the form, stress on the sheet 3 in the multi-direction transport member 4 can be circumvented effectively.

To make a skew correction, preferably the sheet transport apparatus comprises a guide member 9 against which a sheet 3 transported on the skew by the multi-direction transport member 4 is abutted, the guide member 9 for regulating a side position of the sheet 3.

To perform direction switch control of the multi-direction transport member 4 and reliably make the skew correction, preferably the sheet transport apparatus comprises the guide member 9 and a transport direction switch unit 8 that can switch the transport direction of the sheet 3 by the multi-direction transport member 4 at a predetermined timing.

Further, as a preferred form of the transport direction switch unit 8 in the combination form of "guide member+transport direction switch unit," the transport direction switch unit can switch the transport direction of the sheet 3 by the multi-direction transport member 4 into a direction side along the guide member 9 just after the sheet 3 transported on the skew by the multi-direction transport member 4 is abutted against the guide member 9

The "direction side along the guide member 9" mentioned here includes not only the direction along the guide member 9, but also a shallow direction going from the skew transport direction to the direction along the guide member 9.

According to the form, the stress of the edge of the sheet 3 on the guide member 9 can be decreased.

In the combination form of "guide member+transport direction switch unit," the guide member 9 may be placed movably and the transport direction switch unit 8 may change the transport direction of the sheet 3 by the multi-direction transport member 4 by moving the guide member 9.

Further, as a representative form of the multi-direction transport member 4 when changing the transport direction relative to the height direction, the drive transport member and 5 the driven transport member 6 can be supported swingably along the height direction roughly orthogonal to a nip face direction of the sheet 3 and a nip area between both the transport members 5 and 6 can be set downstream in the transport direction of the sheet 3 from a swing supporting point.

The invention is not limited to the sheet transport apparatus and is also applied to an image formation apparatus incorporating the sheet transport apparatus.

In this case, according to the invention, there is provided an image formation apparatus comprising an image formation module for forming an image on a sheet, and a sheet transport apparatus for transporting a sheet to an image transfer part of the image formation module, and any of the sheet transport apparatus described above may be used as the sheet transport apparatus.

DETAILED DESCRIPTION OF THE PREFERRED EMBODIMENTS

Referring now to the accompanying drawings, there are shown preferred embodiments of the invention.

(First Embodiment)

Figure 1A:
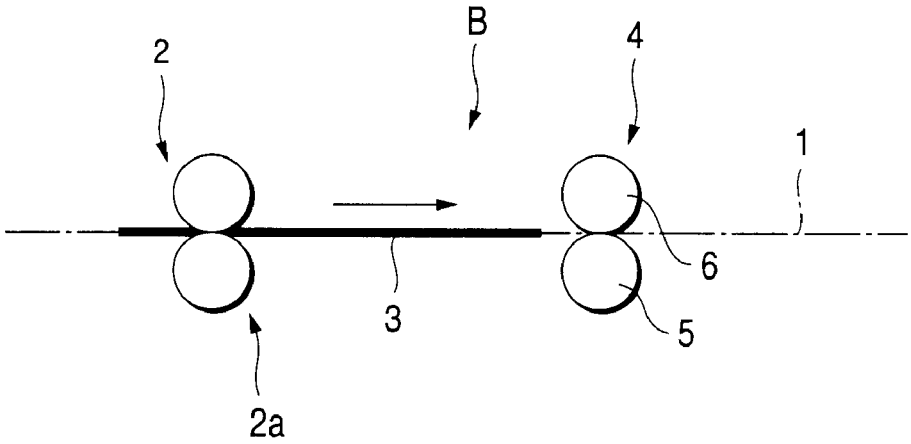
FIG. 1A is a schematic representation to show an outline of a sheet transport apparatus according to the invention and FIG. 1B is an arrow view from B direction in (a)
Figure 1B:
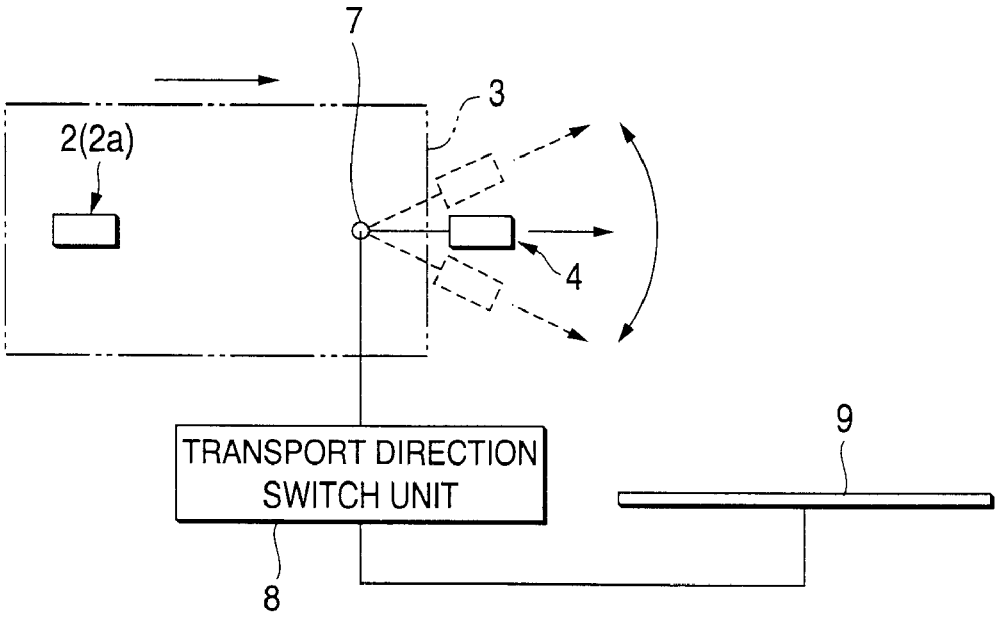
Figure 2:
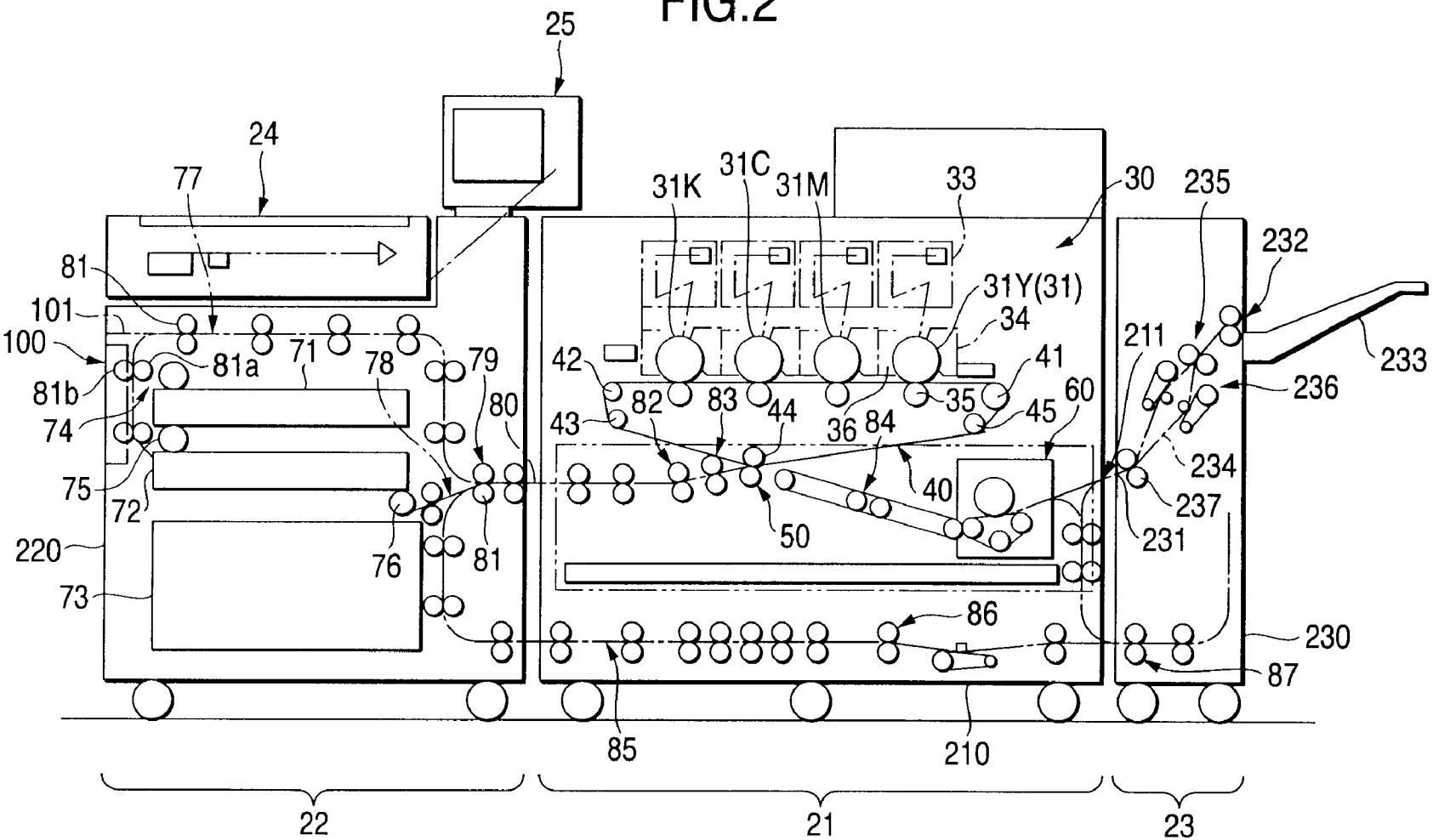
FIG. 2 is a schematic representation to show the whole configuration of an image formation apparatus incorporating a sheet transport apparatus according to a first embodiment of the invention.

FIG. 2 is a schematic representation to show a first embodiment of an image formation apparatus incorporating the invention.

In the figure, the image formation apparatus according to the embodiment is a tandem-type image formation apparatus adopting an intermediate transfer technique and comprises an image formation unit 21 accommodating an image formation module 30, a sheet supply unit 22 being placed in parallel with the image formation unit 21 for supplying a sheet of paper, etc., (not shown) to the image formation unit 21, and a post processing unit 23 being placed in parallel with the image formation unit 21 for performing post processing for the sheet with an image formed in the image formation unit 21.

In the embodiment, the image formation unit 21 accommodates the image formation module 30 for forming color component toner images (for example, yellow (Y), magenta (M), cyan (C), and black (K)), for example, according to electrophotography. The image formation module 30 comprises photoconductor drums 31 (specifically, 31Y, 31M, 31C, and 31K) placed in parallel for forming and supporting color component toner images. It primarily transfers the color component toner images formed on the photoconductor drums 31 to an intermediate transfer belt 40 in order, secondarily transfers the color component toner images on the intermediate transfer belt 40 to a record sheet supplied from the sheet supply unit 22 with a secondary transfer roll 50, and guides the color component toner images into a fuser 60.

In the embodiment, each photoconductor drum 31 is surrounded by electrophotographic devices such as a uniform charger for charging the photoconductor drum 31 (not shown), a laser light exposure device 33 for writing an electrostatic latent image onto the photo conductor drum 31, a developing device 34 storing color component toner for visualizing the electrostatic latent image on the photoconductor drum 31, a primary transfer roll 35 for transferring color component toner images on the photoconductor drums 31 to the intermediate transfer belt 40, and a cleaner 36 for removing the remaining toner, etc., on the photoconductor drums 31.

The intermediate transfer belt 40 is placed on a plurality of (in the example, five) placement rolls 41 to 45 and is circulated. For example, the placement roll 41 is a drive roll, other placement rolls 42 to 45 are driven rolls, and any one of the placement rolls 42 to 45, for example, the placement roll 43 is made to function as a tension roll for giving a tension to the intermediate transfer belt 40.

In the embodiment, a part of the intermediate transfer belt 40 opposed to the placement roll 44 is set as a secondary transfer part, a secondary transfer roll 50 is placed in contact with the secondary transfer part surface side of the intermediate transfer belt 40, and a transfer bias is applied to space between the secondary transfer roll 50 and the placement roll 44 (functioning as a backup roll) opposed to the secondary transfer roll 50.

Further, in the embodiment, the sheet supply unit 22 has multiple (in the example, three) sheet supply trays 71 to 73 as shown in FIG. 2. Sheets of ordinary paper different in size are stored in the sheet supply trays 71 and 72, and special sheets including sheets having high bending rigidity, such as enamel paper and cardboards are stored in the large-capacity sheet supply tray 73 at the lowest stage.

In the embodiment, the sheet supply trays 71 and 72 have feed rolls 74 and 75 on the opposite side to the image formation unit 21 and the sheet supply tray 73 has a feed roll 76 on the side of the image formation unit 21.

A sheet transport passage from the sheet supply trays 71 and 72 is formed as a bypass transport passage 77 going upward from the opposite side of the sheet supply unit 22 to the image formation unit 21 and going toward the image formation unit 21 using upper space and then going downward.

On the other hand, a sheet transport passage from the sheet supply tray 73 is formed as a direct joint transport passage 78 extending roughly linearly to the image formation unit 21. The direct joint transport passage 78 and the bypass transport passage 77 are connected so as to communicate with a confluence transport passage 79 for delivering a record sheet from a delivery port 80 to the image formation unit 21.

A plurality of paired transport rolls 81 are placed at predetermined intervals on the bypass transport passage 77, the direct joint transport passage 78, and the confluence transport passage 79 of the sheet supply unit 22.

Further, a cover 100 opened and closed facing the bypass transport passage 77 is placed in a part of a unit case 220 of the sheet supply unit 22 at an opposite position to the image formation unit 21.

The cover 100 rotates with the depth of the unit case 220 as a rotation supporting point, for example, and rotatably holds a driven roll 81*b* of the paired transport rolls 81 (81*a* and 81*b*). When the cover 100 is opened, the drive roll 81*a* and the driven roll 81*b* of the transport rolls 81 are separated.

In the embodiment, a joint transport passage 101 extending horizontally toward the opposite side to the image formation unit 21 is defined in a horizontal transport passage portion of the bypass transport passage 77 of the sheet supply unit 22. In a form wherein a different sheet supply unit (not shown) is disposed adjacent to the sheet supply unit 22, for example, the joint transport passage 101 serves as a transport passage for accepting a record sheet supplied from the different sheet supply unit and guiding the record sheet into the bypass transport passage 77 or serves as a manual insertion part of a record sheet into the sheet supply unit 22.

Further, in the embodiment, an image read unit 24 and a user operation section 25 are disposed on the top of the sheet supply unit 22.

The image read unit 24 optically reads an image of an original placed on an original bed, and is made up of a light source, a reflecting mirror, an image forming lens, a CCD sensor, etc., for example.

In the embodiment, as shown in FIG. 2, the postprocessing unit 23 has an entrance opening 231 at a position of a unit case 230 corresponding to a record sheet ejection port 211 opened in a unit case 210 of the image formation unit 21 and has an exit opening 232 made at a position of the unit case 230 on the opposite side to the image formation unit 21.

In the example, the entrance opening 231 is made at a predetermined position of the lower half portion of the postprocessing unit 23 (less than half of the height dimension of the postprocessing unit 23); the exit opening 232 is made at a predetermined position of the upper half portion of the postprocessing unit 23 (part exceeding half of the height dimension of the postprocessing unit 23). A sheet ejection tray 233 is attached to the unit case 230 corresponding to the exit opening 232.

Further, an inclined transport passage 234 going in a slanting direction is provided between the entrance opening 231 and the exit opening 232 and branches at an intermediate point to two, and curl correction units 235 and 236 for correcting up curl and down curl are disposed in the branch transport passages.

An appropriate number of (in the example, three) pairs of transport rolls 237 are placed on the inclined transport passage 234.

A sheet transport passage in the image formation unit 21 comprises not only a path for introducing a sheet S supplied from the sheet supply unit 22 into the secondary transfer part and then allowing the sheet S to pass through the fuser 60 and ejecting the sheet S to the postprocessing unit 23, but also a path for inverting the sheet S delivered from the fuser 60 and returning the sheet S to the secondary transfer part.

Figure 3:
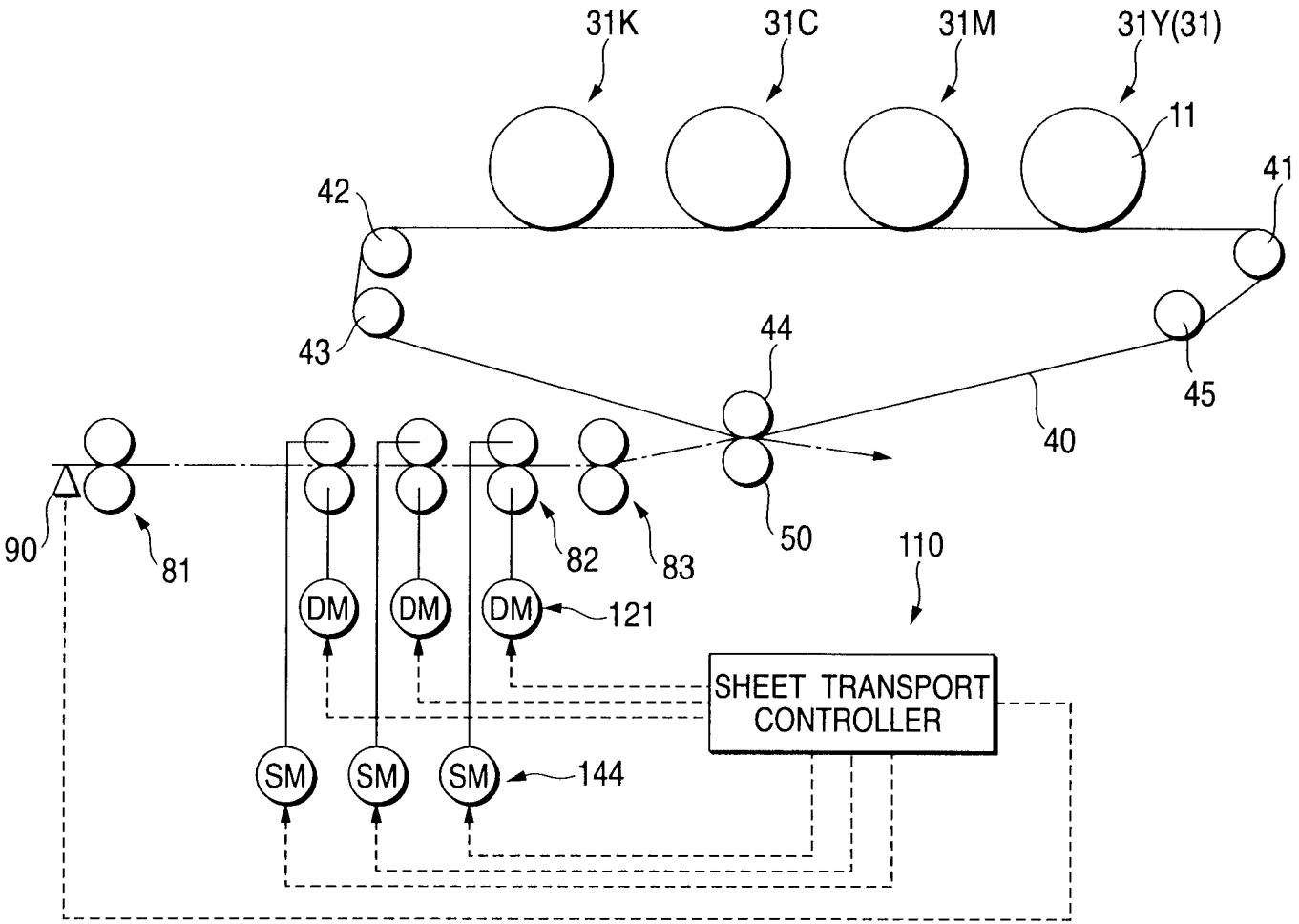
FIG. 3 is a schematic representation to show the main part of the sheet transport apparatus according to the first embodiment of the invention.

Particularly, in the sheet transport apparatus according to the embodiment, as shown in FIGS. 2 and 3, a plurality of (in the example, three) pairs of multi-direction transport rolls 82 (specifically, 82*a* to 82*c*) are disposed upstream from the secondary transfer part, and a pair of registration rolls 83 is disposed between the multi-direction transport rolls 82 and the secondary transfer part.

In the sheet transport apparatus, the side of a sheet is registered to the side initial position by the multi-direction transport rolls 82 and the rotation speed of the registration rolls 83 placed before the secondary transfer part is controlled, whereby the registered sheet is transported to the secondary transfer part and the sheet after passing through the secondary transfer part is transported to the fuser 60, for example, on a transport belt 84.

In FIG. 3, numeral 90 denotes a position sensor placed just after the transport rolls 81 positioned upstream from the multi-direction transport rolls 82.

Further, a sheet return mechanism used in the embodiment transports a record sheet delivered from the fuser 60 by an appropriate number of transport rolls 86 along a return path 85 shaped like a loop; an inversion part 87 (in the example, formed using lower space in the post processing unit 23) is placed at an intermediate point on the return path 85 and the sheet is inverted through the inversion part 87.

A part of the return path 85 is connected so as to communicate with the confluence transport passage 79 using space in the sheet supply unit 22.

Here, the multi-direction transport rolls 82 used in the embodiment will be discussed in detail.

Figure 4:
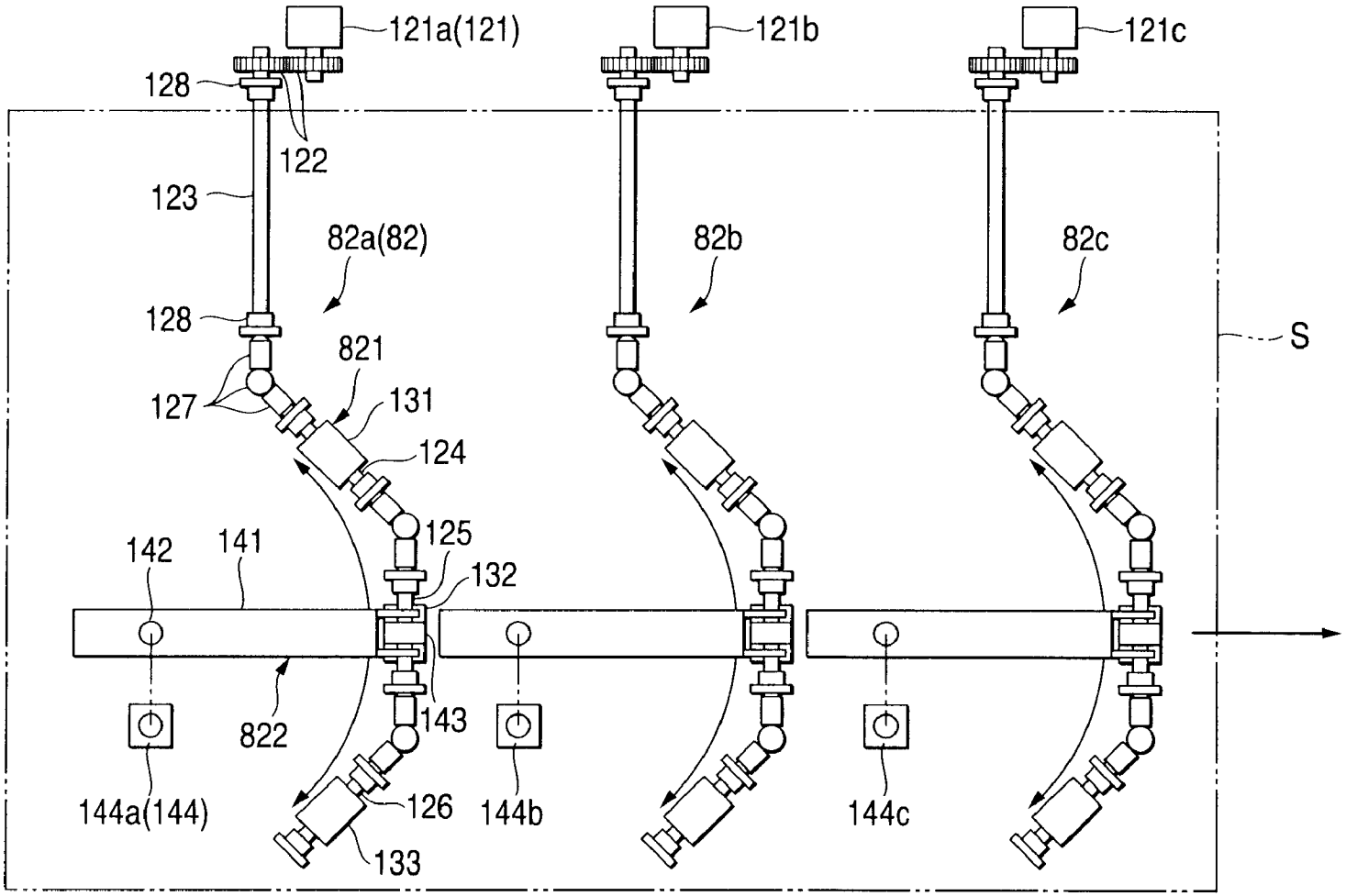
FIG. 4 is a schematic representation of a plan view to show multi-direction transport rolls (skew rolls) according to the first embodiment of the invention.

Each of the multi-direction transport rolls 82 (82*a* to 82*c*) comprises a drive transport roll 821 and a driven transport roll 822 for coming in contact with the drive transport roll 821 and rolling, for example, as shown in FIGS. 3 and 4, and can change the transport direction of the sheet S to the left or right slanting direction other than the straight-ahead direction.

More specifically, the drive transport roll 821 transmits the drive force from a drive motor 121 (specifically 121*a* to 121*c*) through a gear train 122 to a first rotation shaft 123, second to fourth rotation shafts 124 to 126 are joined to the first rotation shaft 123 in order through joint members 127 which are bendable and can transmit rotation, and are placed as projection shaped roughly like a mountain toward the travel direction of the sheet, and further drive roll bodies 131 to 133 are fixed to the second to fourth rotation shafts 124 to 126.

Numeral 128 denotes a bearing member for rotatably supporting each of the rotation shafts 124 to 126.

Particularly, in the example, the drive roll bodies 131 to 133 are placed at positions corresponding to a tip rotation locus of a virtual rotation arm with the virtual center as the rotation center; for example, assuming that the straight-ahead direction of the sheet is the center direction, the left and right slanting directions are set to the roughly symmetrical positional relationship with respect to the center direction.

The driven transport roll 822 comprises a swing arm 141 supported swingably along the nip face direction of the sheet S and a driven roll body 143 supported on the free end side of the swing arm 141 for driven rotation and placed in contact with the drive roll body 131 to 133 of the drive transport roll 821 placed downstream in the transport direction of the sheet S from a swing supporting point 142 of the swing arm 141, for example, as shown in FIG. 4.

Figure 5:
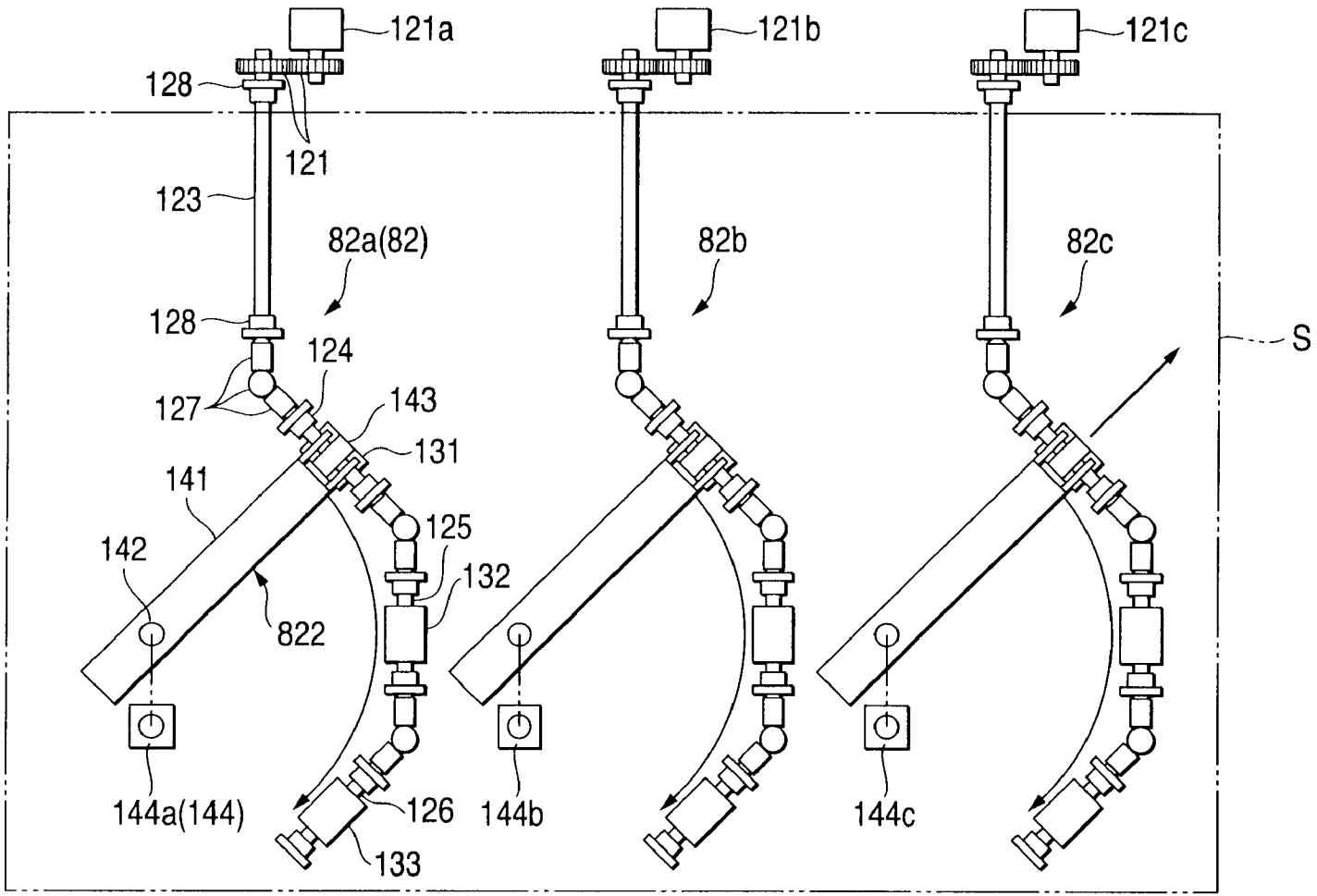
FIG. 5 is a schematic representation to show the operation state of the multi-direction transport rolls according to the first embodiment of the invention.

The drive force from each swing motor 144 (specifically, 144*a* to 144*c*) is transmitted to each swing arm 141 through a drive transmission mechanism 145 of a gear train, a belt pulley, etc., (see FIG. 7). As shown in FIG. 5, as each swing arm 141 is swung at a predetermined angle, the driven roll body 143 and any of the drive roll bodies 131 to 133 are placed in contact with each other so as to rotate in the same direction in nip area.

Figure 6:
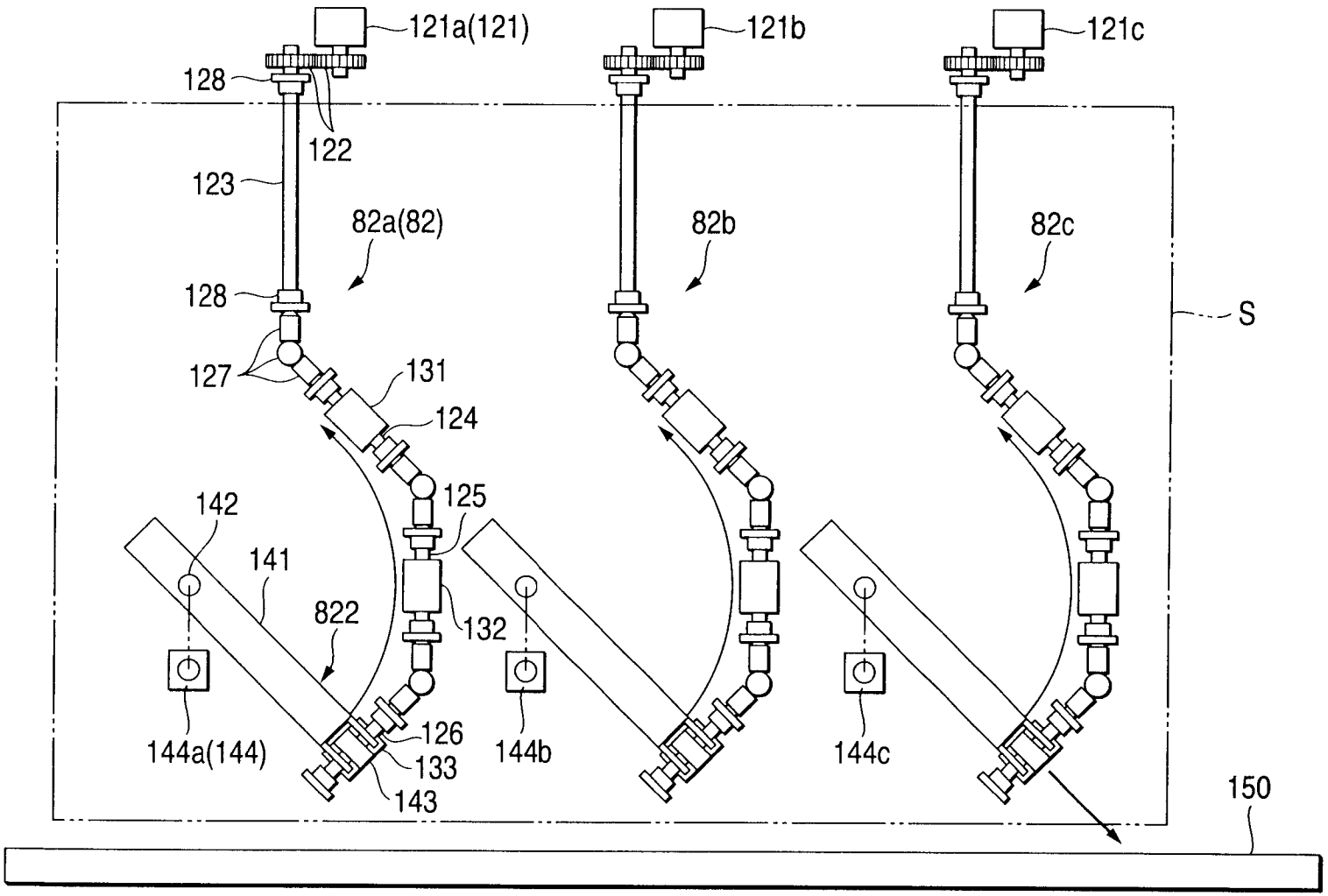
FIG. 6 is a schematic representation to show the positional relationship between the multi-direction transport rolls and a side guide.

Further, a side guide 150 is placed on sides of the multi-direction transport rolls 82, as shown in FIG. 6.

The side guide 150 regulates the side position of the sheet S. Usually, one side guide may be provided for a system requiring only one side reference, but more than one side guide may be provided for a system including more than one side reference (for example, a system wherein the side position of the sheet S is changed alternately) or the position of the side guide 150 may be movable.

Figure 8:
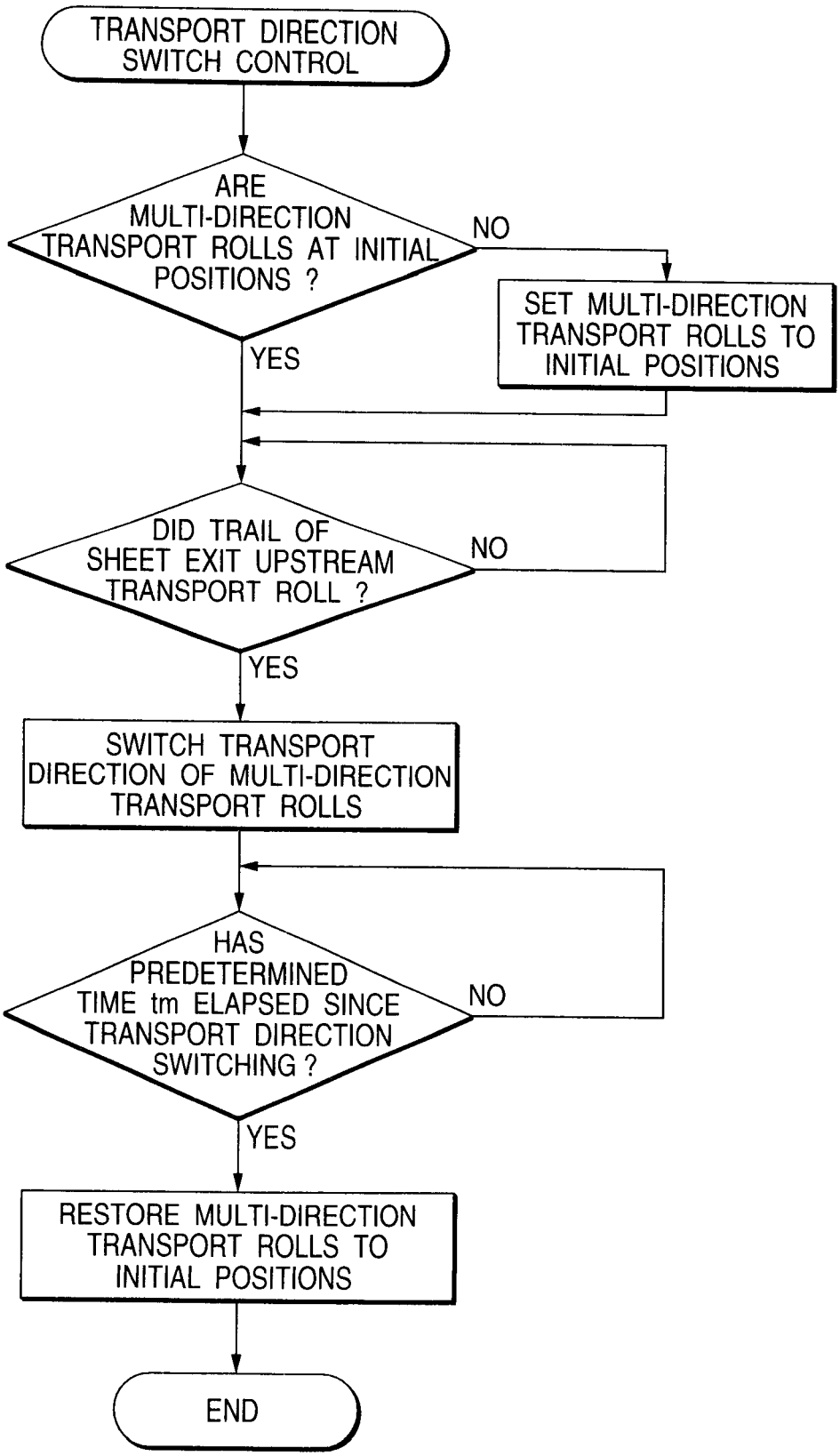
FIG. 8 is a flowchart to show transport direction switch control processing of the sheet transport apparatus according to the first embodiment of the invention.

In the embodiment, as shown in FIG. 3, a sheet transport controller 110 is provided for inputting a start signal (not shown) and a detection signal (not shown) from the position sensor 90, for example, and executing transport direction switch control processing, for example, as shown in FIG. 8 and sending a control signal to the drive motors 121 (specifically, 121*a* to 121*c*), the swing motors 144 (specifically, 144*a* to 144*c*), etc.

Next, the operation of the image formation apparatus (centering on the sheet transport apparatus) according to the embodiment will be discussed.

Now assuming that a sheet is delivered from either the sheet supply tray 71 or 72 of the sheet supply unit 22, the sheet is delivered via the bypass transport passage 77 and the confluence transport passage 79 to the image formation unit 21 through the delivery port 80, and is transported through the multi-direction transport rolls 82 and the registration rolls 83 to the secondary transfer part.

In this state, a color toner image formed in the image formation module 30 is transferred to the sheet and the sheet to which the color toner image is transferred is passed through the fuser 60 and then is transported to the postprocessing unit 23.

In the postprocessing unit 23, the sheet is transported via the inclined transport passage 234. In this process, for example, either the curl correction unit 235 or 236 performs postprocessing (curl correction) for the sheet if the sheet is curled, and the sheet is ejected to the sheet ejection tray 233.

The record sheet delivered from the sheet supply tray 73 is a special sheet including enamel paper, a cardboard, etc.; the record sheet is transported via the direct joint transport passage 78 and the confluence transport passage 79 to the image formation unit 21 through the delivery port 80 and thus is transported to the secondary transfer part without bend formation, a jam, etc.

Figure 9:
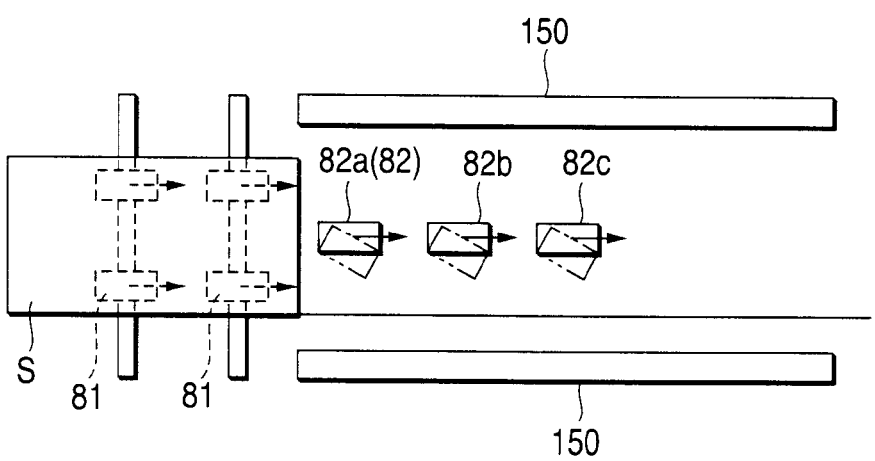
FIG. 9 is a schematic representation to show a simplified model of the sheet transport apparatus according to the first embodiment of the invention.

In the operation process, the transport process of the sheet S before arriving at the secondary transfer part is as shown in FIGS. 9 to 11.

First, as a start switch (not shown) is turned on, the sheet transport controller 110 drives the drive motors 121 for rotating the drive roll bodies 131 to 133 of the drive transport rolls 821 of the multi-direction transport rolls 82 (82*a* to 82*c*).

The sheet transport controller 110 uses a sensor (not shown) to sense whether or not the multi-direction transport rolls 82 (82*a* to 82*c*) are at initial positions (in the example, positions shown in FIG. 4). If the multi-direction transport rolls 82 (82*a* to 82*c*) are set to other positions than the initial positions, the sheet transport controller 110 sets the multi-direction transport rolls 82 to the initial positions.

Thus, as shown in FIG. 9, before the sheet S rushes into the multi-direction transport rolls 82 (82*a* to 82*c*), each of the multi-direction transport rolls 82 (82*a* to 82*c*) has the driven transport roll 822 placed in contact with the drive roll body 132 of the drive transport roll 821 (positional relationship shown in FIG. 4).

Figure 7A:
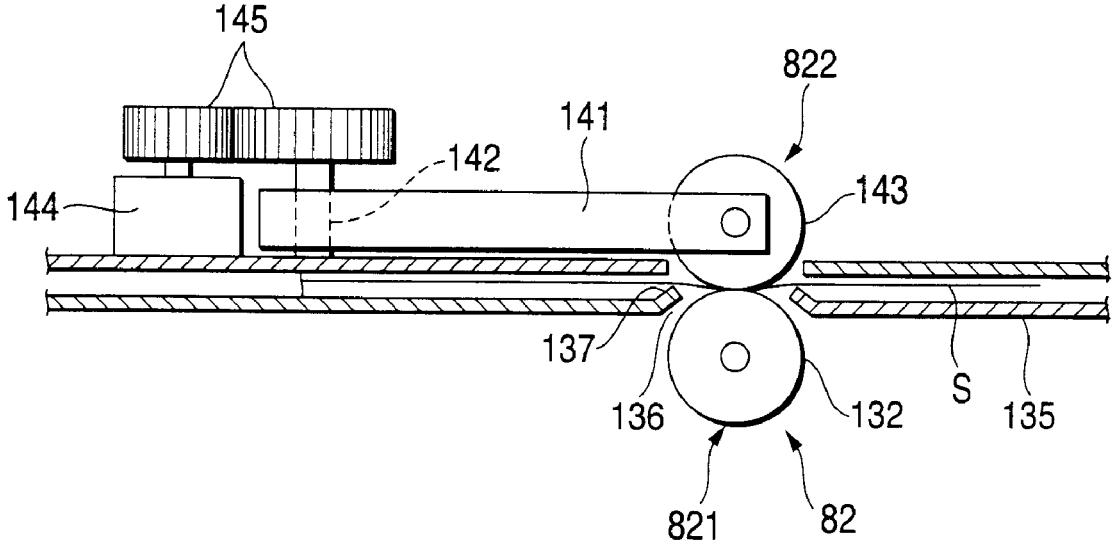
FIG. 7A is a schematic representation to show the nip state between a drive transport roll and a driven transport roll of the multi-direction transport roll according to the first embodiment of the invention and FIG. 7B is a schematic representation to show non-nip state between both the transport rolls.

In this state, when the sheet S rushes into the multi-direction transport roll 82 (82*a*), in the multi-direction transport roll 82 (82*a*), the driven roll body 143 of the driven transport roll 822 transports the sheet S to the nip between the driven roll body 143 and the drive roll body 132 of the drive transport roll 821, as shown in FIG. 7A.

Figure 10A:
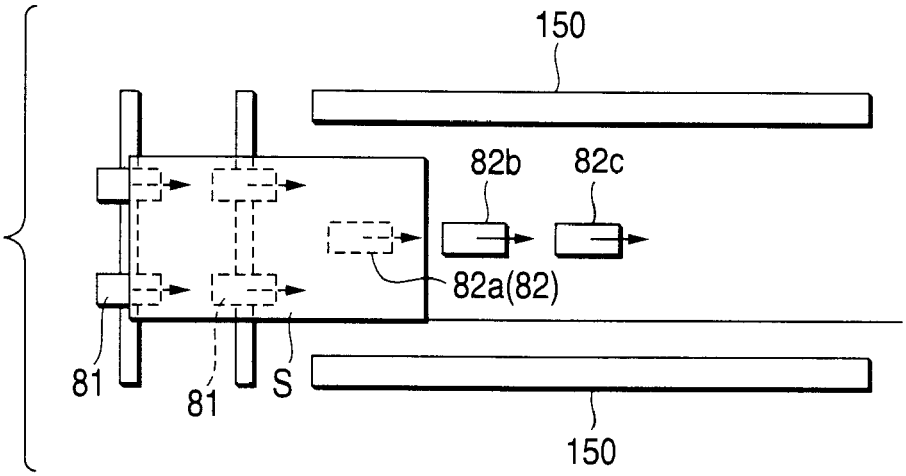
FIGS. 10A and 10B are schematic representations to show the sheet transport process of the model of the sheet transport apparatus according to the first embodiment of the invention.

In this case, the transport direction of the lead of the sheet S by the multi-direction transport roll 82 (82*a*) is the straight-ahead direction as shown in FIG. 10A and the transport direction of the latter half portion of the sheet S by the upstream transport roll 81 is the straight-ahead direction.

Thus, the transport direction of the sheet S by the multi-direction transport roll 82 (82*a*) is the straight-ahead direction, the same as the transport direction of the sheet S by the upstream transport roll 81 with the position fixed, and the sheet S is grip-transported between the drive transport roll 821 and the driven transport roll 822 and advances straightly and no stress occurs on the sheet S.

Figure 7B:
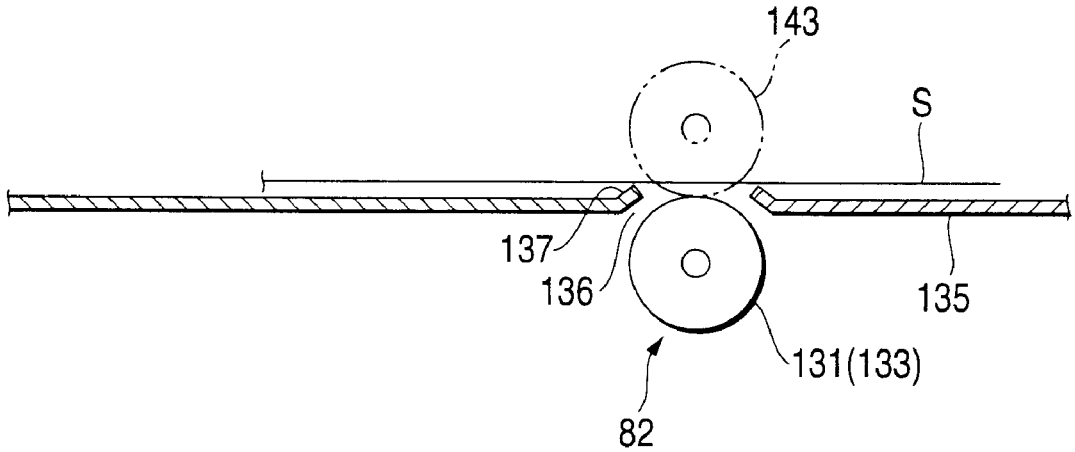

At this time, the drive roll body 131, 133 other than the drive roll body 132 of the drive transport roll 821 is rotated in a non-nip state with the driven roll body 143, as shown in FIG. 7B.

Thus, a situation in which the drive roll body 131, 133 of the multi-direction transport roll 82 comes in contact with the sheet S is possible; each drive roll body 131, 133 is in contact only with one side of the sheet S and transport force scarcely acts on the sheet S.

Particularly, in the embodiment, as shown in FIGS. 7A and 7B, an opening 136 is made in a frame 135 on the drive transport roll 821 side and the drive roll body 131 to 133 and the driven roll body 143 come in contact with each other and roll; a rise part 137 is formed in the periphery of the opening 136 and the drive roll body 131 to 133 is placed lower than the opening 136 face in the presence of the rise part 137. Thus, unless the drive roll body (for example, 132) is placed in the nip state with the driven roll body 143, a situation in which the sheet S comes in contact with the drive roll body 131, 133 in a non-nip state is avoided and a situation in which the transport operation of the sheet S is impaired is prevented reliably.

Figure 10B:
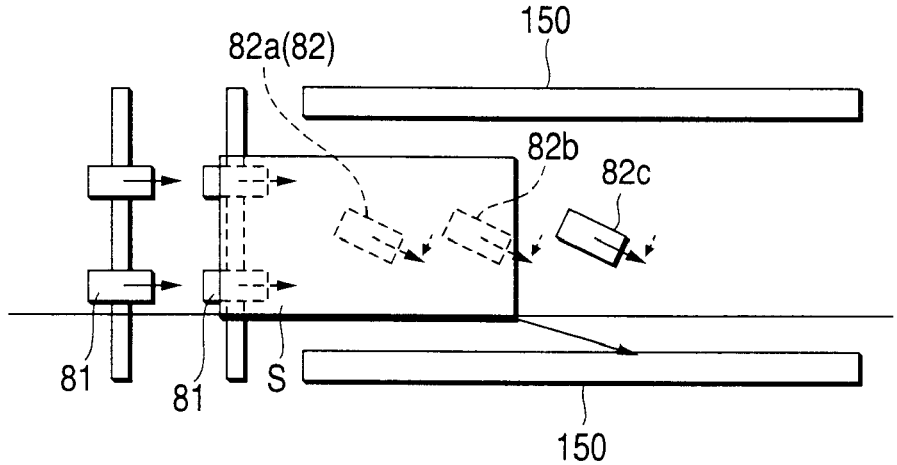

After this, the transport operation of the sheet S is advanced and as shown in FIG. 10B, the sheet S is nip-transported only on the multi-direction transport roll 82 (82*a*, 82*b*) side provided that the trail of the sheet S exits the upstream transport roll 81.

Figure 11A:
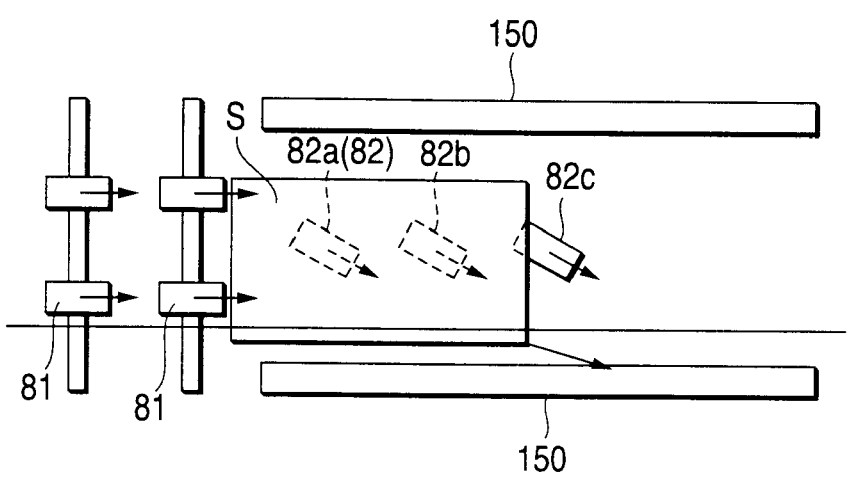
FIGS. 11A to 11C are schematic representations to show the sheet transport process of the model of the sheet transport apparatus according to the first embodiment of the invention.
Figure 11B:
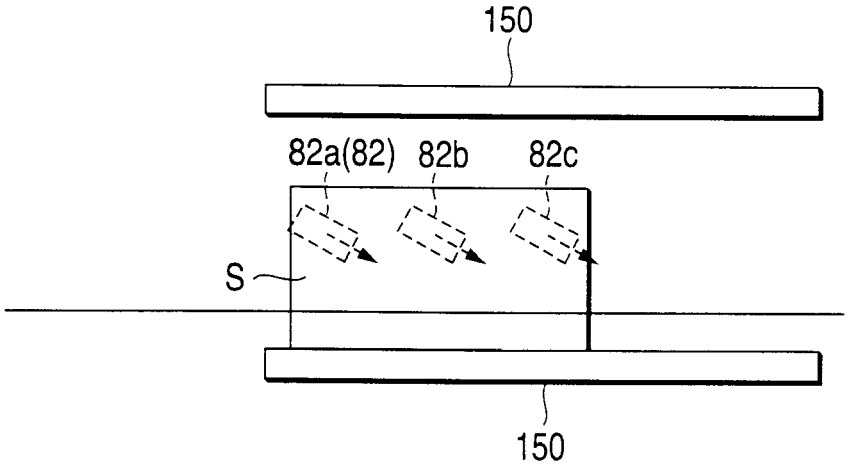

At this time, the sheet transport controller 110 issues a switch instruction of the transport direction of the sheet by the multi-direction transport roll 82 before the trail of the sheet S exits the immediately preceding upstream transport roll 81 (provided that the transport force of the upstream transport roll 81 is received) as shown in FIG. 8, swings the driven transport roll 822 in the right slanting direction relative to the travel direction of the sheet S, for example, as shown in FIG. 6, switches the transport direction of the sheet by the multi-direction transport roll 82 into the right slanting direction relative to the travel direction of the sheet provided that the trail of the sheet S exits the upstream transport roll 81 as shown in FIG. 11B, and holds the sheet S in the state shown in FIG. 6 (nip transport of the sheet S with the driven roll body 143 and the drive roll body 133).

Then, the sheet S is transported in the right slanting direction relative to the travel direction of the sheet S by the multi-direction transport rolls 82 (82*a* to 82*c*) just after the sheet S exits the upstream transport roll 81.

At this time, when the driven transport roll 822 is swung and the driven roll body 143 nips the sheet S with the drive roll body 133 of the drive transport roll 821, a holding force of the sheet S occurs between the drive roll body 133 and the driven roll body 143 and the multi-direction transport rolls 82 grip-transport the sheet S toward the right slanting direction relative to the travel direction of the sheet S.

Thus, the transport force toward a plurality of transport directions does not occur at any point of the sheet S and the transport force in a predetermined direction acts only on the sheet S and therefore the multi-direction transport rolls 82 do not cause any stress to occur on the sheet S.

When a predetermined time tm has elapsed since skew transport of the sheet by the multi-direction transport rolls 82 (82*a* to 82*c*) was performed, as shown in FIG. 11B, the skew-transported sheet S arrives at the side guide 150, the position of the side edge of the sheet S is regulated by the side guide 150, and skew correction of the sheet S is executed.

Figure 11C:
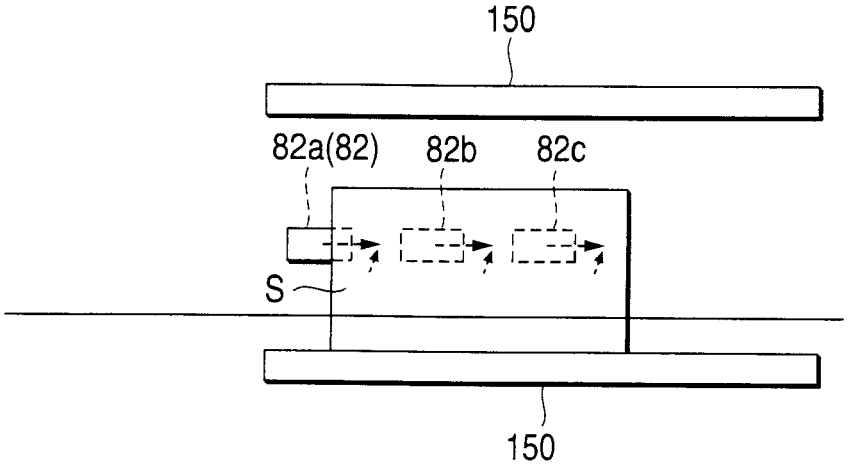

At this time, in the embodiment, the multi-direction transport rolls 82 are restored to the initial positions shown in FIG. 4, as shown in FIG. 11C provided that the skew correction terminates (in the example, provided that the predetermined time tm has elapsed since the start time of the skew transport by the multi-direction transport rolls 82), so that the sheet S after undergoing the skew correction is transported along the side guide 150 with the registration state held.

The multi-direction transport rolls 82 take inclined positions toward the side guide 150, and transport the sheet S toward the side guide 150. In a state in which the sheet abuts against the side guide 150, if the transport force given by the multi-direction transport rolls 82 to the sheet is disassembled into the component for transporting the sheet along the side guide 150 and the force pressing the sheet against the side guide 150, the sheet is pressed against the side guide 150 by the pressing force.

Next, the arm drive motor 144, 175 returns the swing arm to the initial position from the position directed to the side guide 150. During the return operation, the arm drive motor 144, 175 is controlled so that the force given by the multi-direction transport rolls 82 of the swing arm to the sheet S does not exceed the pressing force. As the pressing force changes in response to swinging of the swing arm, the rotation speed of the arm drive motor 144, 175 is changed accordingly.

As an alternative method, during the return operation, driving the arm drive motor 144, 175 may be stopped and the swing arm may be made rotatable. Since the multi-direction transport rolls 82 of the swing arm rotate at all times, the reaction force of the pressing force acts on the swing arm from the side guide 150 and the swing arm is naturally returned to the initial position.

A sheet speed control area may be provided downstream from the transport area where sheet skew correction is made. At the sheet skew correction time, the sheet speed in the transport direction changes because of the transport force changing in response to the swing angle from the swing arm. To perform precise registration regardless of the sheet speed change, speed control section for performing sheet speed control is placed in the speed control area so that the sheet arrives at a predetermined position at a predetermined timing. The speed control section comprises sheet position detection section and sheet transport section capable of performing sheet speed control. The speed control section registers the sheet lead at a predetermined position at a predetermined timing by the sheet transport section in response to the detection result of the detection section.

In this state, unnecessary pressing of the sheet S after undergoing the skew correction against the side guide 150 by the multi-direction transport rolls 82 is eliminated and a large frictional resistance force does not occur between the sheet S and the side guide 150.

Thus, in the embodiment, if the skew correction of the sheet S is made, a stress does not occur on the sheet S and moreover a large frictional resistance force does not occur either between the sheet S and the side guide 150, so that transport resistance variations and transport timing variations are lessened and a skew correction system for enabling stable sheet transport can be provided.

In the embodiment, the transport direction of the sheet S by the multi-direction transport rolls 82 is restored to the initial position, but the invention is not limited to it. For example, the transport direction of the sheet S by the multi-direction transport rolls 82 may be once set to a direction at an inclination angle shallower than the skew direction and then be restored to the initial position.

According to this modification, the situation in which a large frictional resistance force occurs between the sheet S after undergoing the skew correction and the side guide 150 can also be suppressed effectively.

Since the sheet skew correction in the related art mainly adopts the slip transport technique, the roll nip technique or the gate technique is adopted as the registration roll 83 for considering the variations in the arrival time of the sheet S at the transfer part.

However, in the embodiment, as described above, the variations in the arrival time of the sheet S at the transfer part are small and thus can be corrected simply by varying the transport speed of the registration roll 83 and the need for once stopping the sheet S on the registration roll 83 in the lead registration of the sheet S is eliminated and the stop margin of the sheet S becomes unnecessary accordingly, improving productivity.

In the sheet skew correction in the related art, the nip pressure of the skew roll is strengthened for stabilizing the skew operation. Thus, the force pressing the sheet against the side guide also becomes strong and the sheet is bent between the side guide and the skew roll (when the sheet is thin, it is buckled).

As the sheet is bent (buckled), the skew performance worsens and the alignment performance between an image and the sheet worsens.

In the embodiment, however, the variations in the arrival time of the sheet at the transfer part can be corrected simply by varying the transport speed of the registration roll 83 and thus the nip pressure of the multi-direction transport rolls 82 for executing skew transport can be set to a low pressure and the alignment performance is improved accordingly.

Further, the friction coefficient varies depending on the type of sheet S and thus in the related art, it is necessary to vary the nip pressure of the skew roll for each sheet to run for providing sheet transport force.

In contrast, in the embodiment, the variations in the arrival time of the sheet at the transfer part can be corrected simply by varying the transport speed of the registration roll 83 and thus if the friction coefficient changes from one sheet S to another or the sheet transport force varies, various types of sheets can be run.

The friction coefficient, transport resistance, or shape of the multi-direction transport roll 82 or the side guide 150 changes with environment change.

In the embodiment, however, the variations in the arrival time of the sheet at the transfer part can be corrected simply by varying the transport speed of the registration roll 83 and thus if the friction coefficient transport resistance, or shape of the multi-direction transport roll 82 or the side guide 150 changes and the sheet transport force varies, the sheet can be run.

Generally, if paper powder or the coat material on the surface of a sheet adheres to a roll, secular change of friction coefficient change or small diameter change caused by abrasion can occur.

In the related art, this kind of secular change is considered for determining the sheet transport force and the sheet transport speed.

In the embodiment, however, the variations in the arrival time of the sheet at the transfer part can be corrected simply by varying the transport speed of the registration roll 83 and thus if the sheet transport force varies with secular change, it is made possible to run the sheet S and the multi-direction transport rolls 82 can be made long life.

(Second Embodiment)

Figure 12:
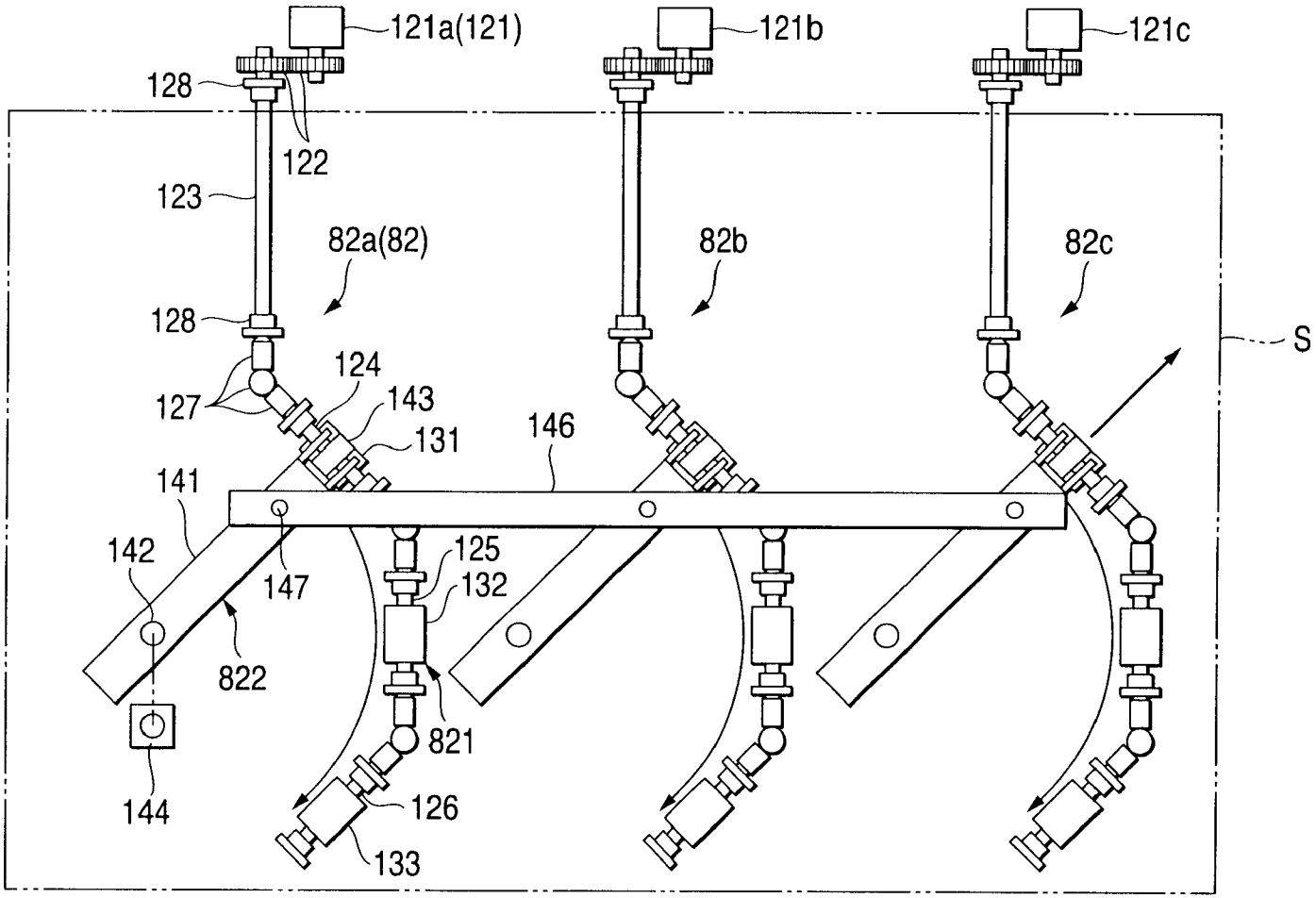
FIG. 12 is a schematic representation of a plan view to show multi-direction transport rolls (skew rolls) in a sheet transport apparatus according to a second embodiment of the invention.

FIG. 12 is a schematic representation to show the main part of a sheet transport apparatus used with an image formation apparatus according to a second embodiment of the invention.

In the sheet transport apparatus shown in the figure, multi-direction transport rolls 82 comprise each a drive transport roll 821 similar to that in the first embodiment, but a driven transport roll 822 differs from that in the first embodiment.

That is, in the second embodiment, the driven transport roll 822 comprises a swing arm 141 supported swingably along the nip face direction of a sheet S and a driven roll body 143 supported on the free end side of the swing arm 141 for driven rotation and placed in contact with a drive roll body 131 to 133 of the drive transport roll 821 placed downstream in the transport direction of the sheet S from a swing supporting point 142 of the swing arm 141 like the driven transport roll 822 in the first embodiment.

However, the swing arms 141 are joined by a joint arm 146 with pins 147. For example, the drive force from a swing motor 144 is transmitted to the swing arm 141 in the driven transport roll 822 of the multi-direction transport roll 82*a* through a drive transmission mechanism of a gear train, a belt pulley, etc., (not shown), and the swing arms 141 in the driven transport rolls 822 of the multi-direction transport rolls 82*b* and 82*c* at the following stages are ganged through the joint arm 146.

Figure 13:
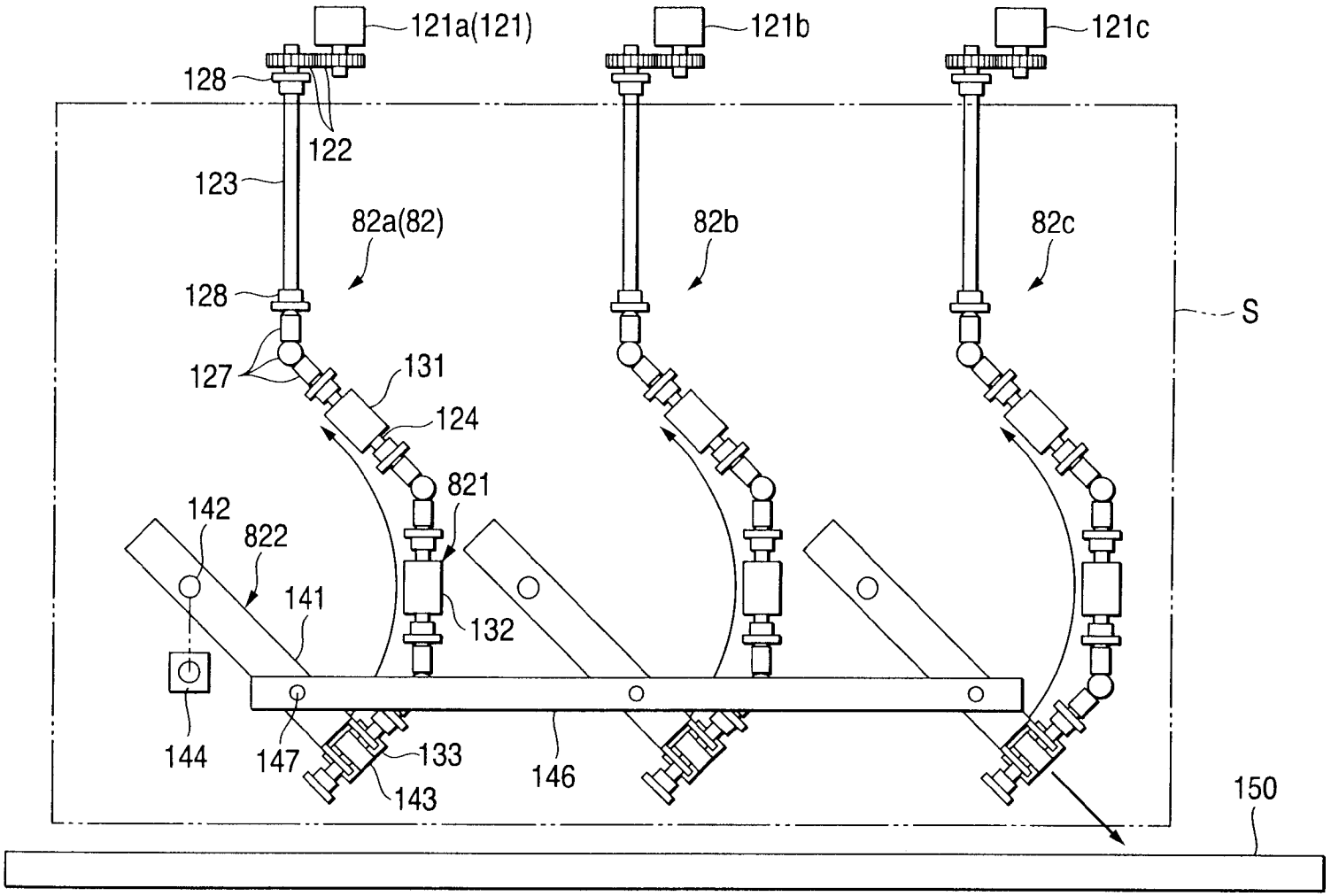
FIG. 13 is a schematic representation to show the positional relationship between the multi-direction transport rolls and a side guide.

In the embodiment, to make a skew correction of the sheet S, a side guide 150 may be disposed on sides of the multi-direction transport rolls 82, as shown in FIG. 13.

Components similar to those previously described with reference to FIGS. 2 to 11 are denoted by the same reference numerals in FIGS. 12 and 13 and will not be discussed again.

According to the second embodiment, one swing motor 144 may be used to swing the swing arms 141 of the driven transport rolls 822, so that the configuration of the transport direction switch mechanism of the multi-direction transport rolls 82 is simplified as compared with that in the first embodiment.

(Third Embodiment)

Figure 14A:
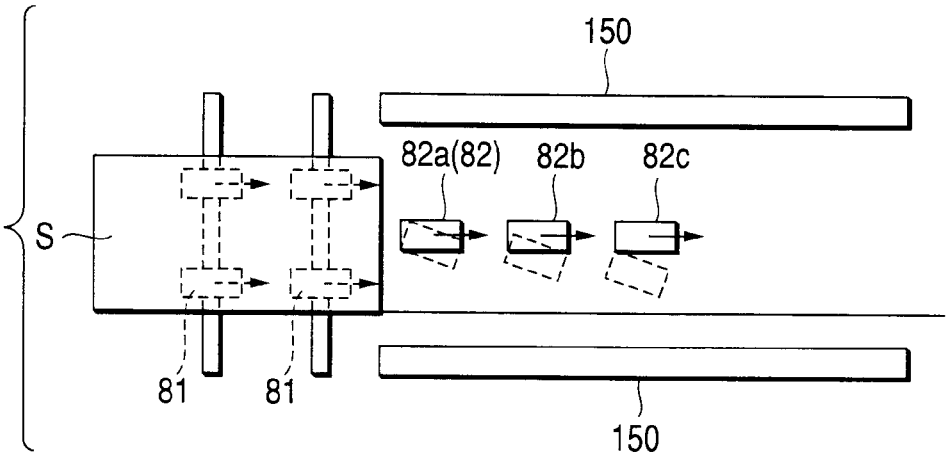
FIG. 14A is a schematic representation to show a simplified model of the sheet transport apparatus according to a third embodiment of the invention and FIG. 14B is a schematic representation to show the transport direction switch mechanism of the multi-direction transport rolls of the sheet transport apparatus according to the third embodiment of the invention.

FIG. 14A is a schematic representation to show the main part of a sheet-transport apparatus used with an image formation apparatus according to a third embodiment of the invention.

In the sheet transport apparatus shown in the figure, multi-direction transport rolls 82 (specifically, 82*a* to 82*c*) comprise three drive transport rolls 821 roughly similar to those in the first embodiment and one swing-type driven transport roll 822.

Figure 14B:
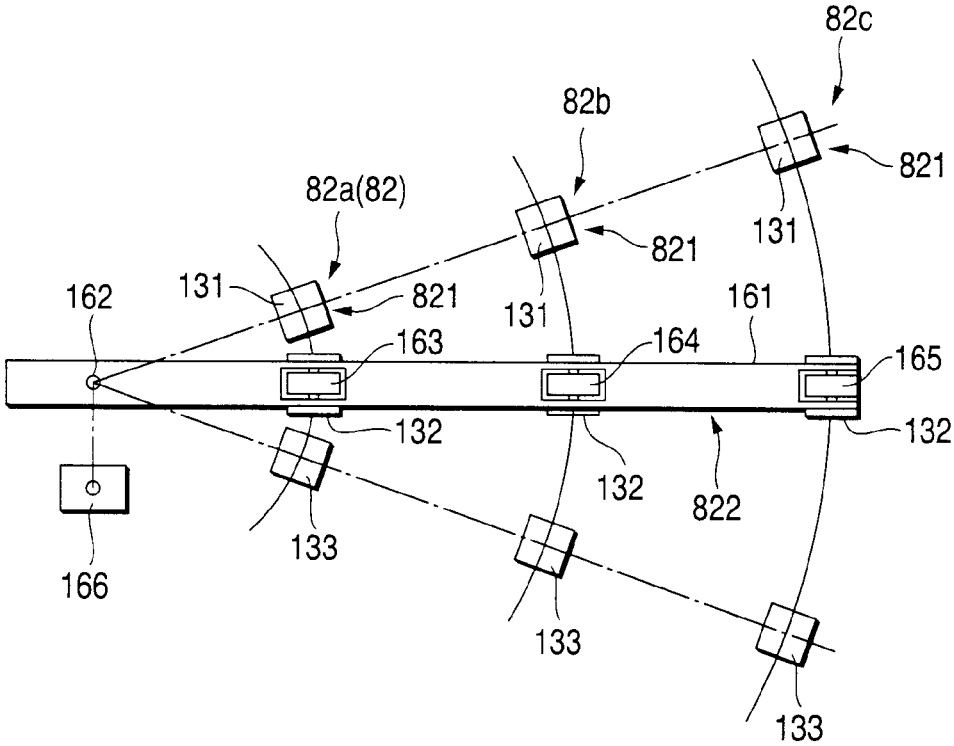

In the third embodiment, the basic configuration of the drive transport rolls 821 is roughly similar to that in the first embodiment; however, unlike the first embodiment, as shown in FIG. 14B, drive roll bodies 131 to 133 of the multi-direction transport rolls 82 (82*a* to 82*c*) are laid out in similar shape in order from the side of a swing supporting point 162 of the swing-type driven transport roll 822.

On the other hand, the swing-type driven transport roll 822 comprises a common swing arm 161 supported swingably along the nip face direction of a sheet S and driven roll bodies 163 to 165 disposed at a plurality of points of the common swing arm 161 for driven rotation and placed in contact with drive roll bodies 131 to 133 of the drive transport rolls 821 placed downstream in the transport direction of the sheet S from the swing supporting point 162 of the common swing arm 161, as shown in FIG. 14B.

The drive force from a swing motor 166 is transmitted to the common swing arm 161 through a drive transmission mechanism of a gear train, a belt pulley, etc., (not shown). As shown in FIG. 14B, as the common swing arm 161 is swung at a predetermined angle, the driven roll bodies 163 to 165 and any of the drive roll bodies 131 to 133 of each of the multi-direction transport rolls 82 (82*a* to 82*c*) are placed in contact with each other so as to rotate in the same direction in a nip area.

Next, the sheet transport process of the sheet transport apparatus according to the third embodiment is as shown in FIGS. 15 and 16.

Figure 15A:
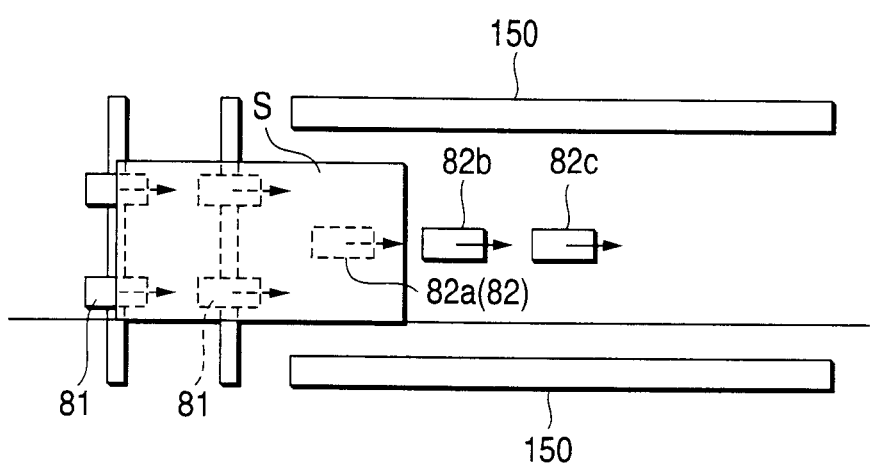
FIGS. 15A and 15B are schematic representations to show the sheet transport process of the model of the sheet transport apparatus according to the third embodiment of the invention.

Now assuming that the sheet S is positioned before rushing into the multi-direction transport rolls 82 (82*a* to 82*c*), the transport direction of the sheet by the multi-direction transport rolls 82 (82*a* to 82*c*) is the straight-ahead direction as shown in FIG. 15A.

Thus, the sheet S transported from an upstream transport roll 81 positioned just before the multi-direction transport rolls 82 (82*a* to 82*c*) travels in a straight line to the multi-direction transport rolls 82, and no stress occurs on the sheet S.

Figure 15B:
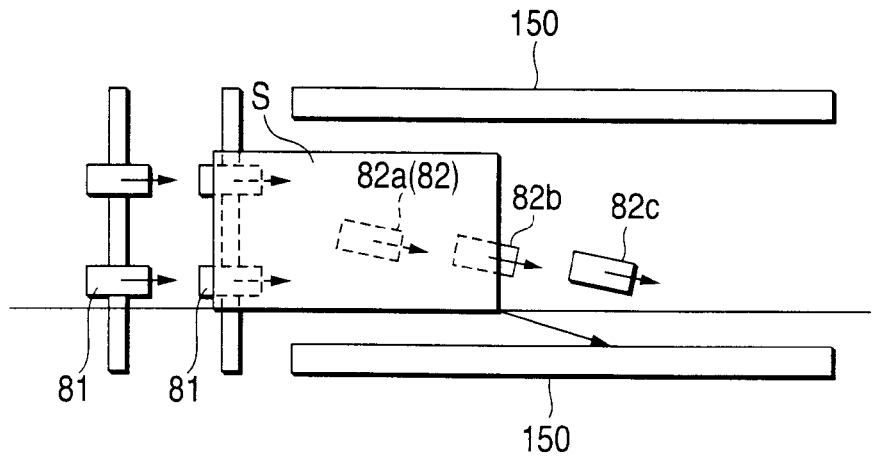
Figure 16A:
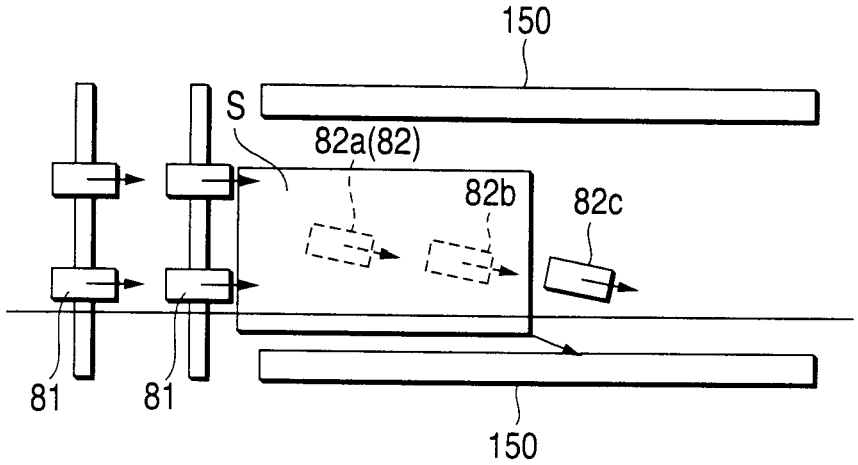
FIGS. 16A to 16C are schematic representations to show the sheet transport process of the model of the sheet transport apparatus according to the third embodiment of the invention.

Before the trail of the sheet S exits the upstream transport roll 81 just before the multi-direction transport rolls 82 (82*a* to 82*c*) (provided that the transport force of the upstream transport roll 81 is received), as shown in FIG. 15B, the swing-type driven transport roll 822 is swung in the right slanting direction relative to the travel direction of the sheet S, as shown in FIG. 16A, the transport direction of the sheet S by the multi-direction transport roll 82 (82*a* to 82*c*) is switched into the right slanting direction provided that the trail of the sheet S exits the upstream transport roll 81 just before the multi-direction transport rolls 82 (82*a* to 82*c*), and as shown in FIG. 11A, and the state of nip transport (grip transport) of the sheet S with the driven roll bodies 163 to 165 of the swing-type driven transport roll 822 and the drive roll body 133 of each drive transport roll 821 is held.

Then, the sheet S is transported in the right slanting direction relative to the travel direction of the sheet S by the multi-direction transport rolls 82 (82*a* to 82*c*) just after the sheet S exits the upstream transport roll 81.

At this time, the transport force in a predetermined direction acts only on the sheet S and therefore the multi-direction transport rolls 82 do not cause any stress to occur on the sheet S.

Figure 16B:
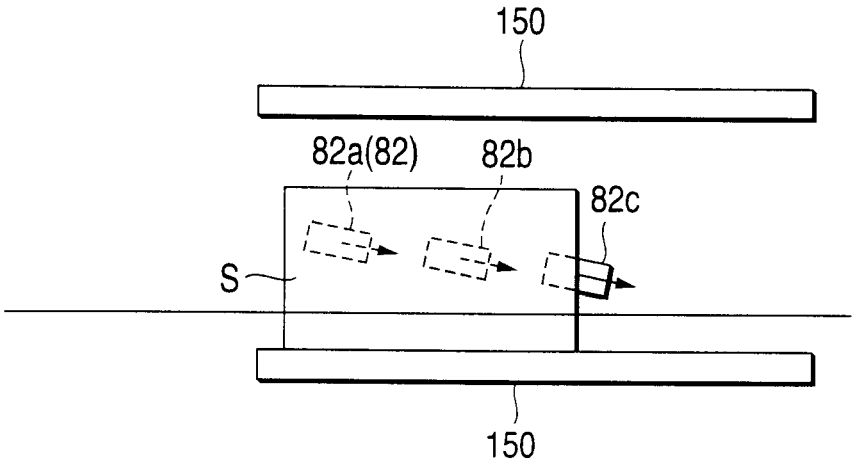

Further, when a predetermined time has elapsed since skew transport of the sheet by the multi-direction transport rolls 82 (82*a* to 82*c*) was performed, as shown in FIG. 16B, the skew-transported sheet S arrives at the side guide 150, the position of the side edge of the sheet S is regulated by the side guide 150, and skew correction of the sheet S is executed.

Figure 16C:
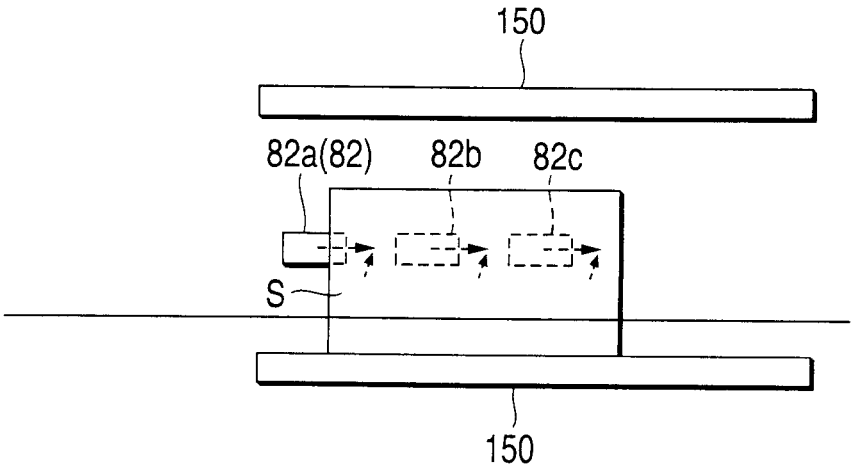

If the multi-direction transport rolls 82 are restored to the initial positions as shown in FIG. 16C provided that the skew correction terminates (for example, provided that the predetermined time has elapsed since the start time of the skew transport by the multi-direction transport rolls 82), the sheet S after undergoing the skew correction is transported along the side guide 150 with the registration state held. Before the multi-direction transport rolls 82 are restored to the initial positions, the multi-direction transport rolls 82 may be once returned to shallower angle position than the skew transport direction.

In this case, unnecessary pressing of the sheet S after undergoing the skew correction against the side guide 150 by the multi-direction transport rolls 82 is eliminated and a large frictional resistance force does not occur between the sheet S and the side guide 150.

(Fourth Embodiment)

Figure 17A:
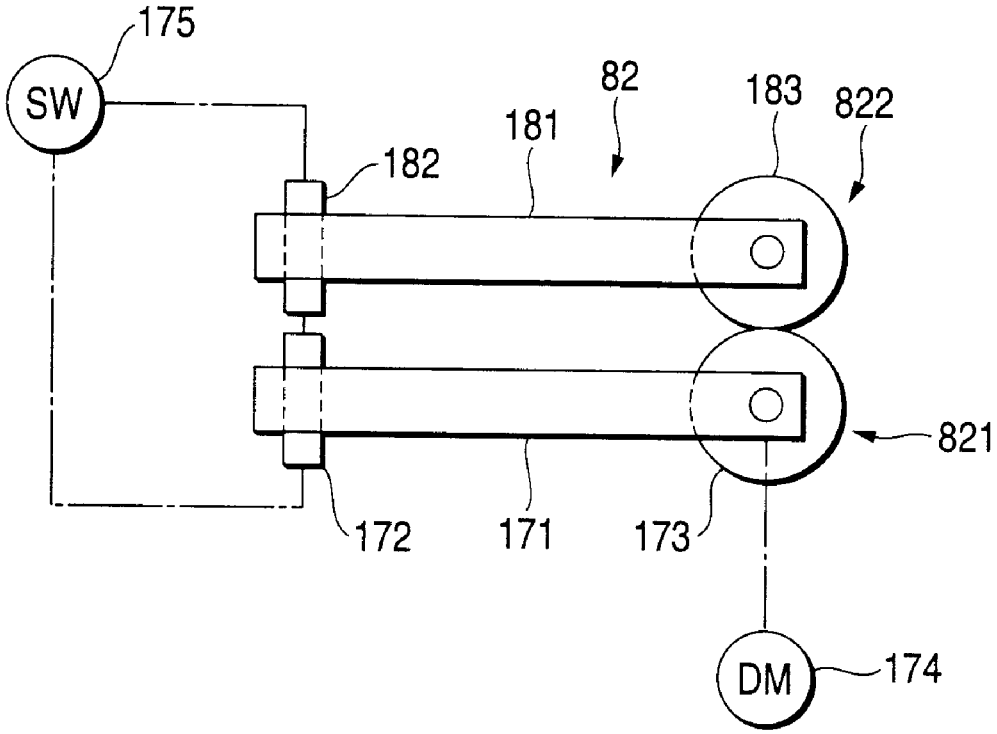
FIG. 17A is a schematic representation to show the main part of a sheet transport apparatus according to a fourth embodiment of the invention and FIG. 17B is a schematic representation of a plan view.
Figure 17B:
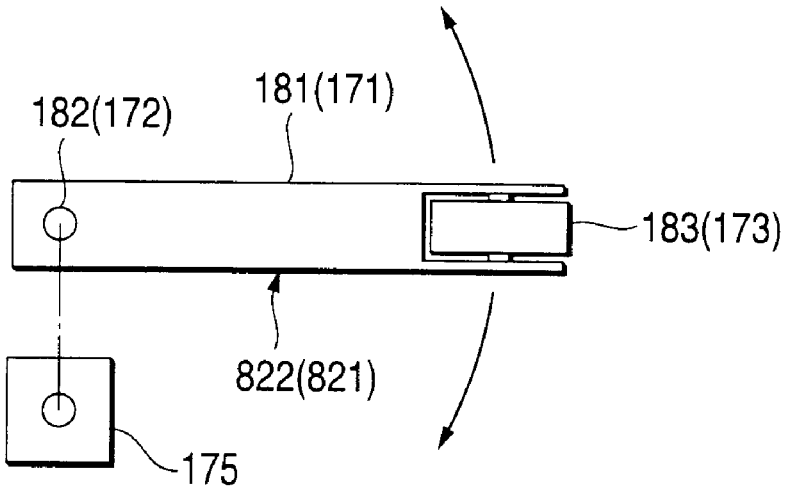

FIG. 17A is a schematic representation to show the main part of a sheet transport apparatus used with an image formation apparatus according to a fourth embodiment of the invention, and FIG. 17B is a schematic representation of a plan view.

In the sheet transport apparatus shown in the figures, a multi-direction transport roll 82 comprises a drive transport roll 821 different from that in the first to third embodiments and a driven transport roll 822 for performing nip transport of a sheet between the drive transport roll 821 and the driven transport roll 822.

In the fourth embodiment, the drive transport roll 821 comprises a swing arm 171 supported swingably along the nip face direction of a sheet and a drive roll body 173 supported on the free end side of the swing arm 171 for rotation and placed downstream in the transport direction of the sheet S from a swing supporting point 172 of the swing arm 171.

Further, the driven transport roll 822 comprises a swing arm 181 supported swingably along the nip face direction of a sheet and a driven roll body 183 supported on the free end side of the swing arm 181 for driven rotation and placed downstream in the transport direction of the sheet from a swing supporting point 182 of the swing arm 181.

The drive roll body 173 is rotated by a drive motor 174 and the swing arms 171 and 181 are swung in conjunction by a swing motor 175 and through a drive transmission mechanism (not shown).

According to the embodiment, the swing angle of the swing arm 171, 181 is controlled, whereby the drive transport roll 821 and the driven transport roll 822 are swung together and the transport direction of the sheet by the multi-direction transport roll 82 can be set to any desired direction.

(Fifth Embodiment)

Figure 18:
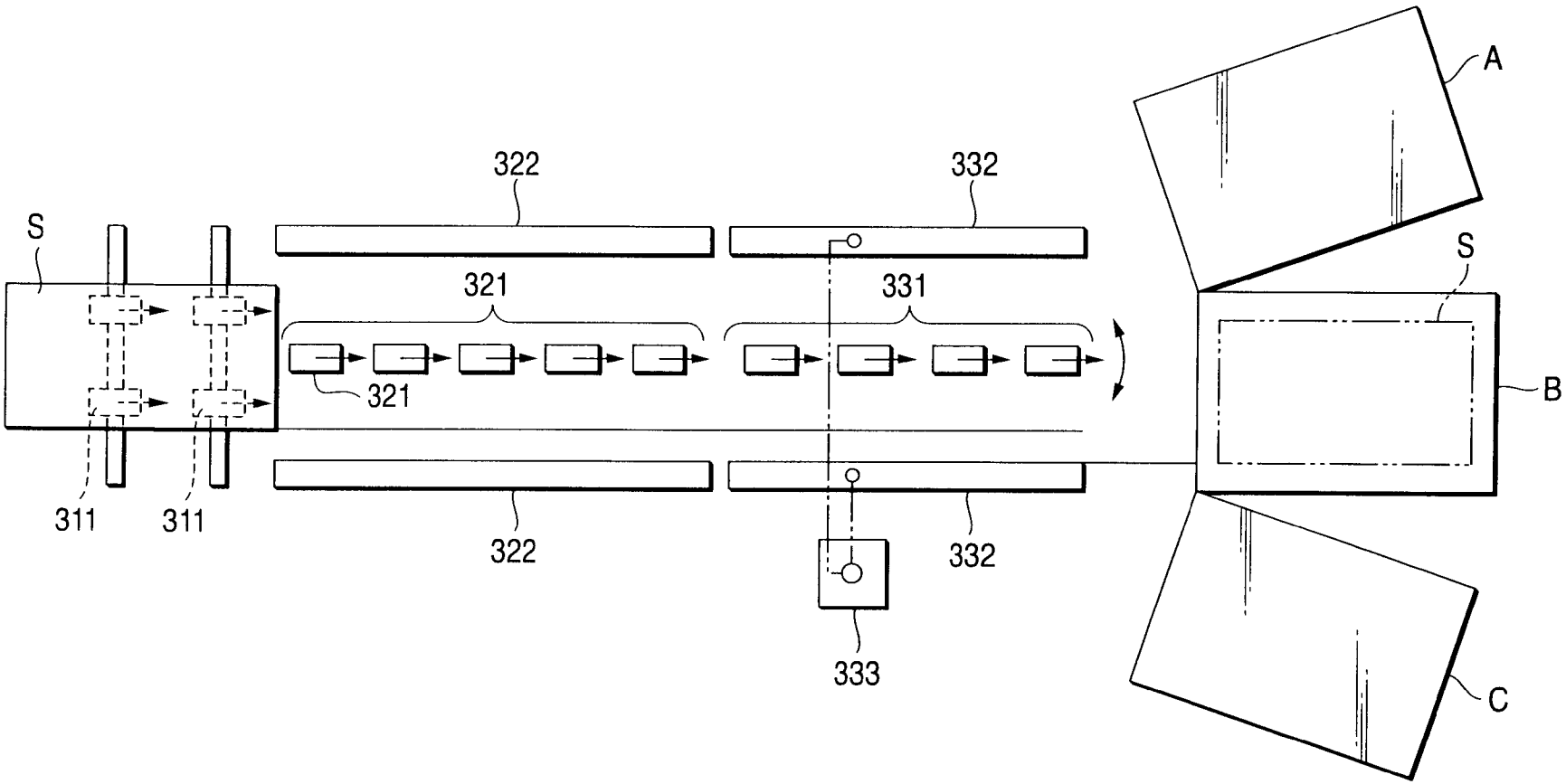
FIG. 18 is a schematic representation to show the main part of a sheet transport apparatus according to a fifth embodiment of the invention.

FIG. 18 is a schematic representation to show the main part of a sheet transport apparatus used with an image formation apparatus according to a fifth embodiment of the invention.

The sheet transport apparatus shown in the figure transports sheets S to three processing units A to C installed at three radial positions, for example, and comprises a predetermined number of usual transport rolls 311 fixed in positions upstream of a sheet transport passage, a predetermined number of (in the example, five) multi-direction transport rolls 321 and side guides 322 fixed in positions downstream, and further a predetermined number of (in the example, four) multi-direction transport rolls 331 and swingable moving side guides 332 downstream. The moving side guides 332 transmit the drive force from a drive motor 333 through a drive transmission mechanism (not shown) and are swung at a predetermined angle.

In the embodiment, the multi-direction transport rolls 321 and 331 switch the sheet transport direction to different directions; the multi-direction transport rolls 321 positioned upstream actively switch the transport direction of the sheet S using the drive force of a swing motor, etc., as in the first to fourth embodiments, while the multi-direction transport rolls 331 positioned downstream passively switch the transport direction of the sheet S in response to attitude change of the moving side guides 332.

As the multi-direction transport rolls 331 for passively switching the transport direction of the sheet S, for example, a roll for swingingly supporting a drive transport roll and a driven transport roll on a swing arm and passively swung in response to an external force from the nip area between the drive and driven transport rolls, for example, can be named.

According to the embodiment, the sheet S transported in a straight line, for example, by the upstream transport rolls 311 is skew-transported toward the side guide 322 on the front side, for example, by the multi-direction transport rolls 321 and is subjected skew correction and then is transported to the moving side guides 332, as shown in FIG. 18.

Figure 19A:
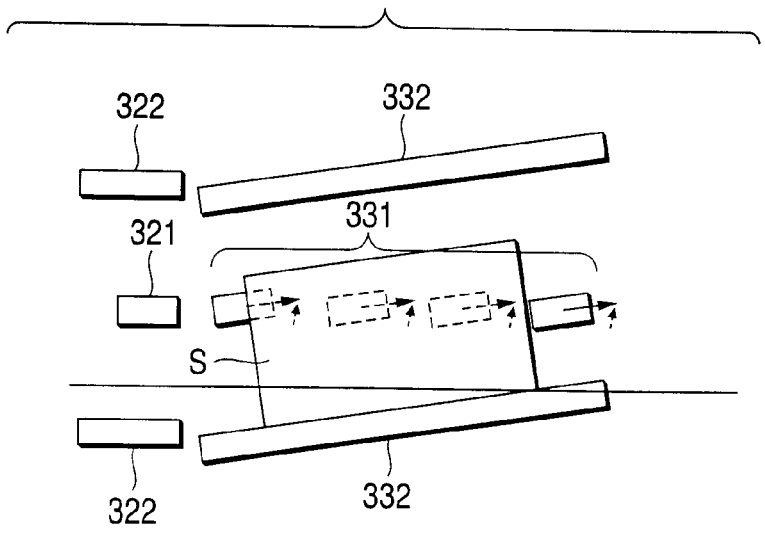
FIGS. 19A and 19B are schematic representations to show an operation example of the sheet transport apparatus according to the fifth embodiment of the invention.
Figure 19B:
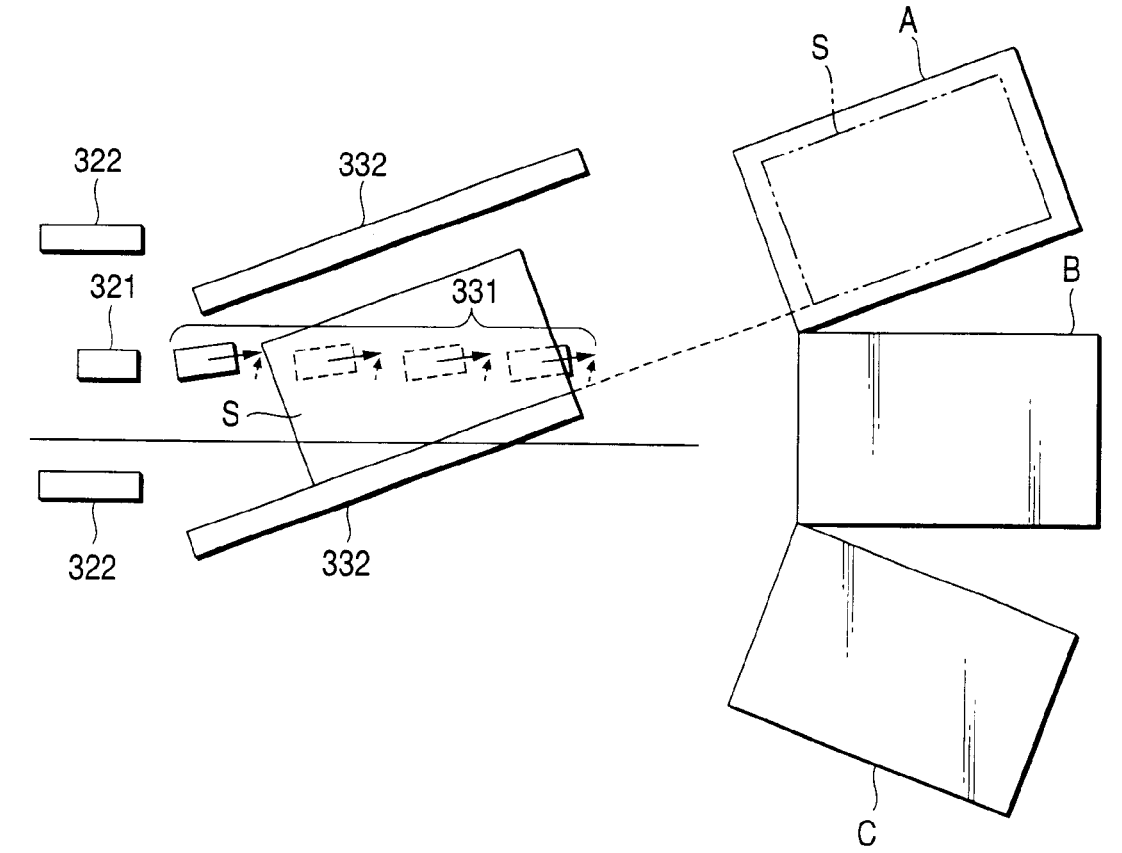

Assuming the case where the sheet S is transported to the processing unit A, for example, at the stage at which the trail of the sheet S exits the side guides 322, the moving side guides 332 are swung gradually toward the processing unit A, as shown in FIGS. 19A and 19B.

In this state, the attitude of the sheet S is changed in a state in which the position of the sheet S is regulated by the swung moving side guides 332. At this time, the multi-direction transport rolls 331 are swung, for example, to change the nip area position with the attitude change of the sheet S for transporting the sheet S toward the direction along the moving side guides 332 and transporting the sheet S to the processing unit A.

Figure 20A:
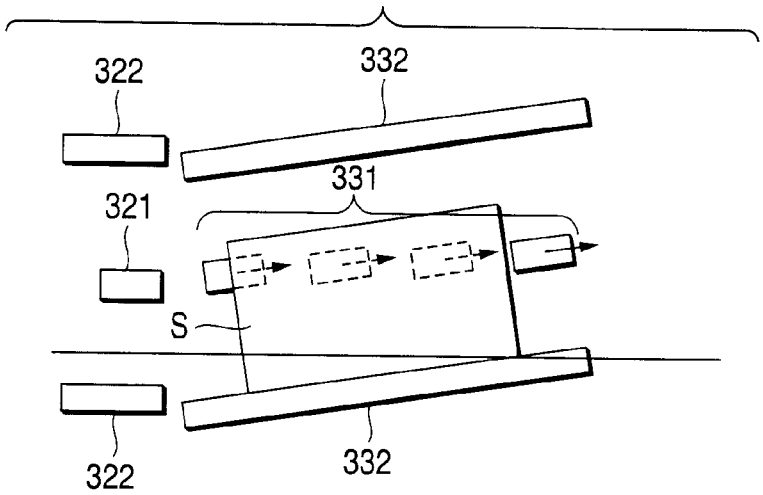
FIGS. 20A and 20B are schematic representations to show a modification of the sheet transport apparatus according to the fifth embodiment of the invention.
Figure 20B:
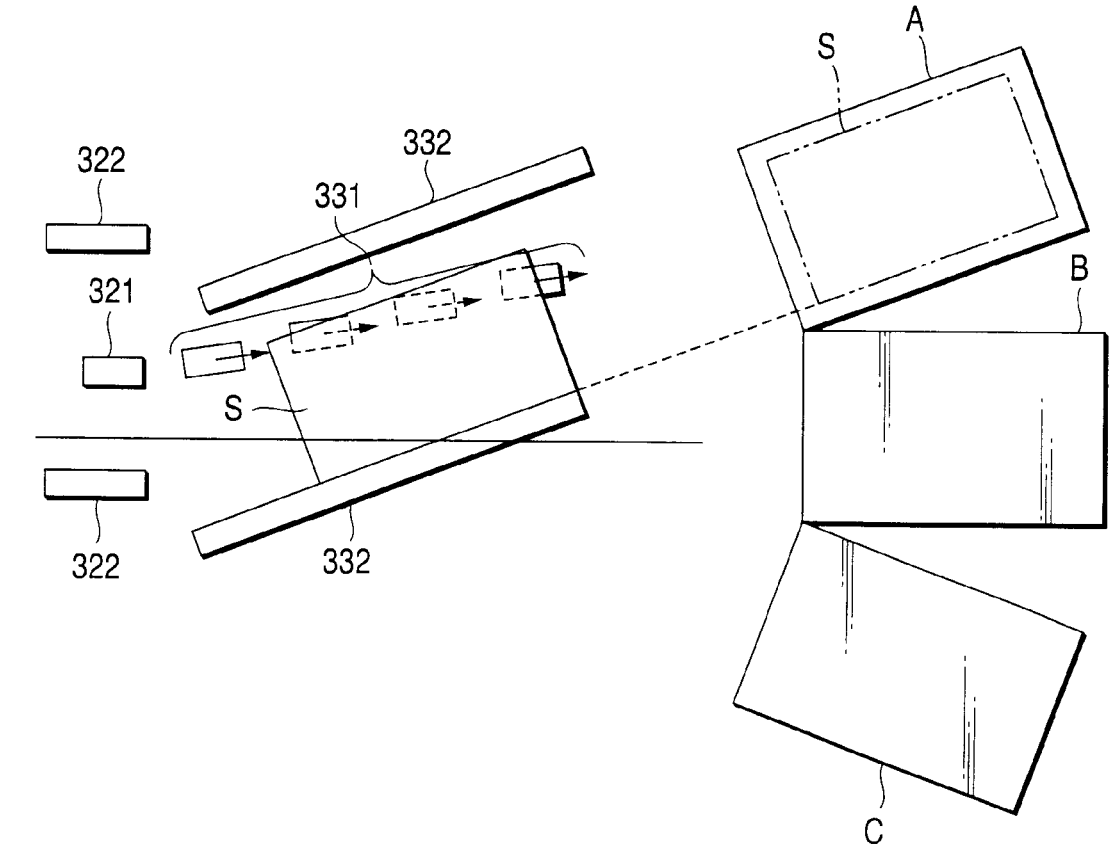

The multi-direction transport rolls 331 may be configured so that they are swung separately below predetermined swing supporting points as shown in FIGS. 19A and 19B or may be configured so that they are swung as a whole with one swing supporting point as the center as shown in FIGS. 20A and 20B.

In the embodiment, the sheet S positioned by the side guides 322 is diverted by the moving side guides 332, but the positional relationship between the side guides 322 and the moving side guides 332 may be inverted for switching the transport direction of the sheet S by the moving side guides 332 and then regulating the side positions of the sheet S by the side guides 322.

(Sixth Embodiment)

Figure 21A:
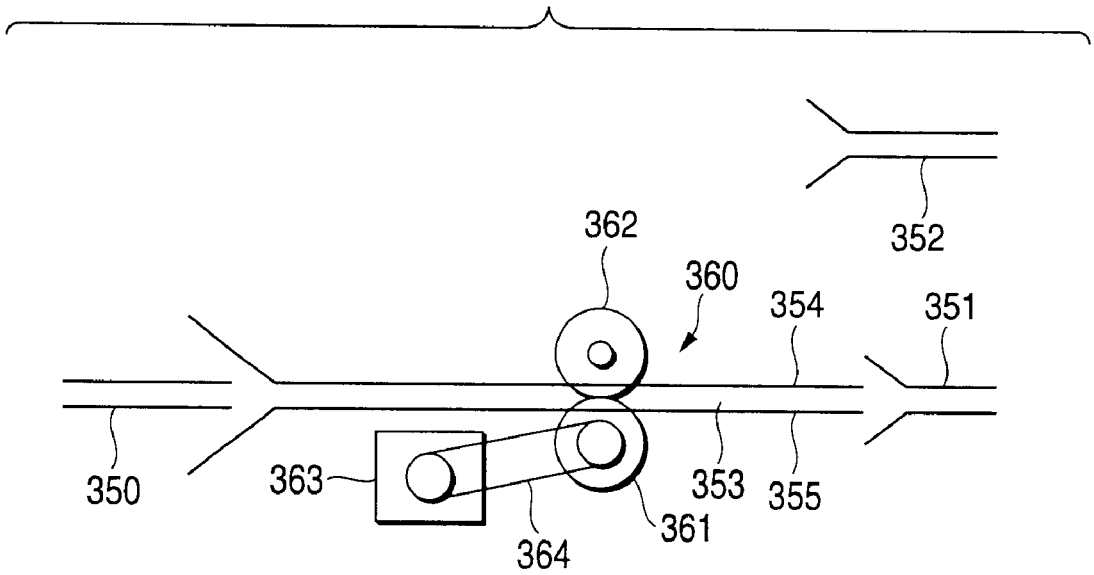
FIG. 21A is a schematic representation to show the main part of a sheet transport apparatus according to a sixth embodiment of the invention and FIG. 21B is a schematic representation to show an operation example of the sheet transport apparatus according to the sixth embodiment of the invention.
Figure 21B:
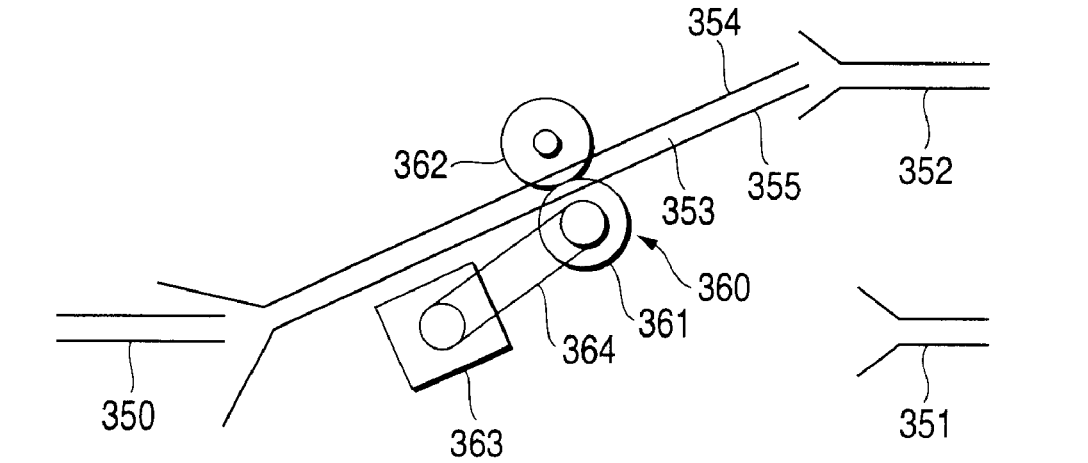

FIGS. 21A and 21B are schematic representations to show the main part of a sheet transport apparatus used with an image formation apparatus according to a sixth embodiment of the invention.

The sheet transport apparatus shown in the figures has a first sheet transport passage 351 connected linearly to a sheet transport passage 350 and a second sheet transport passage 352 placed so as to be deviated in the height direction relative to the sheet transport passage 351 and comprises a switch transport passage 353 tilted up and down, placed between the sheet transport passage 350 and the first, second sheet transport passage 351, 352 and a multi-direction transport roll 360 disposed in the switch transport passage 353.

In the embodiment, the switch transport passage 353 is defined by a pair of chute members 354 and 355, and the multi-direction transport roll 360 is made up of a drive transport roll 361 placed on the side of the lower chute member 354 and a driven transport roll 362 placed on the side of the upper chute member 355, and is moved in one piece in association with switching of the switch transport passage 353.

The drive force of a drive motor 363 is transmitted to the drive transport roll 361 through a drive transmission mechanism 364 of a transmission belt, etc.

According to the embodiment, the switch transport passage 353 is switched, whereby it is made possible to switch the sheet transport direction by the multi-direction transport roll 360 with respect to the height direction, and the switch transport passage 353 can be switched between the state in which the sheet transport passage 350 and the first sheet transport passage 351 are connected as shown in FIG. 21A and the state in which the sheet transport passage 350 and the second sheet transport passage 352 are connected as shown in FIG. 21B.

As described above, according to the invention, at least a part of the transport members is a multi-direction transport member for variably setting the transport direction of the sheet to one of directions, so that the following basic advantages can be provided:

a. To switch the transport direction of a sheet, the transport direction of the sheet by the multi-direction transport member can be set to the direction matched with the rush direction of the sheet at the sheet rushing time, so that there is no fear of giving excessive stress to the sheet at the sheet rushing time.

b. To switch the transport direction of a sheet, the transport direction of the sheet by the multi-direction transport member can be switched after the sheet is received, so that there is no fear of giving excessive stress to the sheet when the transport direction of the sheet is switched.

c. When switch transport of a sheet using the multi-direction transport member and the guide member in combination is performed, the transport direction of the sheet by the multi-direction transport member is variably set appropriately, whereby sheet transport by the multi-direction transport member is grip transport and the frictional resistance force between the sheet and the guide member after the sheet is registered can be decreased.

Thus, the sheet transport resistance variations and the transport timing variations can be lessened, and the transport direction of the sheet can be switched while the sheet is stably transported without giving a stress to the sheet.

What is claimed is:

1. A sheet transport apparatus comprising:

a predetermined number of transport members disposed in a sheet transport passage, wherein a predetermined number of multi-direction transport members among said transport members are adapted to set a sheet transport direction in a plurality of directions with a nipping manner; and a plurality of registrer rolls as a registration member being placed downstream from said multi-direction transport members along the sheet transport direction, is adapted to perform sheet speed control on an aligned sheet so that the aligned sheet arrives at an image transfer part in a predetermined position with a predetermined timing.

2. The sheet transport apparatus according to claim 1, wherein said multi-direction transport member comprises;

a drive transport member driven for rotation, and a driven transport member that comes in contact with said drive transport member and rolling to perform nip transport of the sheet with said drive transport member, and changes the transport direction of the sheet by said drive transport member and said driven transport member.

3. The sheet transport apparatus according to claim 2, wherein at least either of said drive transport member and said driven transport member of said multi-direction transport member is adapted to swing and is supported along a nip face side of the sheet, and a nip area between both said transport members is set downstream in said sheet transport direction from a swing supporting point.

4. The sheet transport apparatus according to claim 3, wherein either of said drive transport member and said driven transport member of said multi-direction transport member comprises;

a plurality of transport bodies disposed along a plurality of transport directions.

5. The sheet transport apparatus according to claim 3, wherein at least either of said drive transport member and said driven transport member of said multi-direction transport member comprises;

a swing arm adapted to swing and supported along the nip face side of the sheet, and a transport body, which comprises opposite mated transport members is placed at a downstream side of the sheet transport direction from a swing supporting point of said swing arm.

6. The sheet transport apparatus according to claim 1, further comprising:

a transport direction switch unit that is capable of switching the sheet transport direction by said multi-direction transport member at a predetermined timing.

7. The sheet transport apparatus according to claim 6, wherein said transport direction switch unit directly or indirectly controls to switch the sheet transport direction by said multi-direction transport member.

8. The sheet transport apparatus according to claim 6, wherein said multi-direction transport member comprises;

a drive transport member driven for rotation, and a driven transport member that comes in contact with said drive transport member and rolling to perform nip transport of the sheet with said drive transport member, upon switching the sheet transport direction, said transport direction switch unit roughly matches the rotation directions of said drive transport member and said driven transport member in the nip area therebetween with the transport direction of the sheet so as to enable to execute grip transport of the sheet with respect to the transport direction of the sheet.

9. A sheet transport apparatus comprising:

a predetermined number of transport members disposed in a sheet transport passage, wherein a predetermined number of multi-direction transport members among said transport members are adapted to set a sheet transport direction in a plurality of directions with a nipping manner;

a plurality of register rolls as a registration member being placed downstream from said multi-direction transport members alone the sheet transport direction, is adapted to perform sheet speed control on an aligned sheet so that the aligned sheet arrives at an image transfer part in a predetermined position with a predetermined timing; and a transport direction switch unit that is capable of switching the sheet transport direction by said multi-direction transport member at a predetermined timing, wherein the sheet transport direction by said multi-direction transport member is changed to a different direction compared to the sheet transport direction by upstream transport member, and said transport direction switch unit sets the sheet transport direction by said multi-direction transport member to the same direction as the sheet transport direction by said upstream side transport member provided that the sheet rushes into said-multi-direction transport member, and sets the sheet transport direction by said multi-direction transport member to a different direction from the sheet transport direction by said upstream side transport member provided that a trail end of the sheet exits said upstream side transport member.

10. The sheet transport apparatus according to claim 1, further comprising;

a guide member against which a sheet transported in a skewed manner by said multi-direction transport member is abutted, said guide member regulating a side position of the sheet.

11. The sheet transport apparatus according to claim 1, further comprising;

a guide member against which a sheet transported in a skewed manner by said multi-direction transport member is abutted, said guide member regulating a side position of the sheet; and a transport direction switch unit that is capable of switching the sheet transport direction by said multi-direction transport member at a predetermined timing.

12. The sheet transport apparatus according to claim 11, wherein said transport direction switch unit switches the skewed sheet transport direction by said multi-direction transport member into a straight direction along said guide member immediately after the sheet transported in a skewed manner by said multi-direction transport member is abutted against said guide member.

13. A sheet transport apparatus comprising:

a predetermined number of transport members disposed in a sheet transport passage, wherein a predetermined number of multi-direction transport members among said transport members are adapted to set a sheet transport direction in a plurality of directions with a nipping manner;

a plurality of register rolls as a registration member being placed downstream from said multi-direction transport members alone the sheet transport direction, is adapted to perform sheet speed control on an aligned sheet so that the aligned sheet arrives at an image transfer part in a predetermined position with a predetermined timing;

a guide member against which a sheet transported in a skewed manner by said multi-direction transport member is abutted, said guide member regulating a side position of the sheet; and a transport direction switch unit that is capable of switching the sheet transport direction by said multi-direction transport member at a predetermined timing; wherein said guide member is placed on the side of the multi-direction transport member and is adapted to move alone the side of the multi-direction transport members to a desired position, and said transport direction switch unit changes the sheet transport direction by said multi-direction transport member by utilizing said guide member.

14. The sheet transport apparatus according to claim 2, wherein said drive transport member and said driven transport member of said multi-direction transport member are adapted to swing and are supported along a height direction roughly orthogonal to nip face side of the sheet, and a nip area between both said transport members is set downstream in the sheet transport direction from a swing supporting point.

15. A sheet transport apparatus comprising:

a predetermined number of transport members disposed in a sheet transport passage, wherein a predetermined number of multi-direction transport members among said transport members are adapted to set a sheet transport direction in a plurality of directions with a nipping manner;

a plurality of register rolls as a registration member being placed downstream from said multi-direction transport members along the sheet transport direction, is adapted to perform sheet speed control on an aligned sheet so that the aligned sheet arrives at an image transfer part in a predetermined position with a predetermined timing;

a guide member against which a sheet transported in a skewed manner by said multi-direction transport member is abutted, said guide member regulating a side position of the sheet; and a transport direction switch unit that is capable of switching the sheet transport direction by said multi-direction transport member at a predetermined timing; wherein said transport direction switch unit switches the skewed sheet transport direction by said multi-direction transport member into a straight direction along said guide member immediately after the sheet transported in a skewed manner by said multi-direction transport member is abutted against said guide member wherein said multi-direction transport member comprises a transport roller that transports a sheet, a swing arm that supports said transport roller at one end of swing rotation, said swing arm is pivoted at an opposite end from said transport roller of the main swing unit, and a drive section that varies a swing angle of said swing arm, wherein said drive section controls driving of said swing arm so that a force pressing the sheet against said guide member by said transport roller becomes larger than a force given to the sheet while said swing arm is brought back to a desired position, when said transport direction switch unit switches the sheet transport direction from a direction directed toward said guide member to a desired direction along said guide member.

16. A sheet transport apparatus comprising:

a predetermined number of transport members disposed in a sheet transport passage, wherein a predetermined number of multi-direction transport members among said transport members are adapted to set a sheet transport direction in a plurality of directions with a nipping manner;

a plurality of register rolls as a registration member being placed downstream from said multi-direction transport members along the sheet transport direction, is adapted to perform sheet speed control on an aligned sheet so that the aligned sheet arrives at an image transfer part in a predetermined position with a predetermined timing;

a guide member against which a sheet transported in a skewed manner by said multi-direction transport member is abutted, said guide member regulating a side position of the sheet; and a transport direction switch unit that is capable of switching the sheet transport direction by said multi-direction transport member at a predetermined timing; wherein said transport direction switch unit switches the skewed sheet transport direction by said multi-direction transport member into a straight direction along said guide member immediately after the sheet transported in a skewed manner by said multi-direction transport member is abutted against said guide member wherein said drive section of said swing arm places said swing arm in a state in which said swing arm can be rotated freely, when said transport direction switch unit switches the sheet transport direction from the direction directed toward said guide member to the desired direction along said guide member.

17. An image formation apparatus comprising:

an image formation module for forming an image on a sheet and sheet transport apparatus according to claim 1 are provided within a same image formation unit, wherein the sheet transport apparatus transports a sheet to an image transfer part of said image formation module.

* * * * *